US011337003B2

(12) United States Patent
Huang et al.

(10) Patent No.: US 11,337,003 B2
(45) Date of Patent: May 17, 2022

(54) AUDIO PLAYBACK CIRCUIT AND TERMINAL

(71) Applicant: HONOR DEVICE CO., LTD., Guangdong (CN)

(72) Inventors: Ting Huang, Shenzhen (CN); Yupeng Qiu, Shenzhen (CN); Yingqun Feng, Shenzhen (CN)

(73) Assignee: HONOR DEVICE CO., LTD., Shenzhen (CN)

( * ) Notice: Subject to any disclaimer, the term of this patent is extended or adjusted under 35 U.S.C. 154(b) by 0 days.

(21) Appl. No.: 17/281,175

(22) PCT Filed: Sep. 24, 2019

(86) PCT No.: PCT/CN2019/107555

§ 371 (c)(1),
(2) Date: Mar. 29, 2021

(87) PCT Pub. No.: WO2020/063594

PCT Pub. Date: Apr. 2, 2020

(65) Prior Publication Data

US 2021/0392437 A1 Dec. 16, 2021

(30) Foreign Application Priority Data

Sep. 30, 2018 (CN) ..... 201811158741.7

(51) Int. Cl.
*H04R 5/033* (2006.01)
*H04R 5/04* (2006.01)

(52) U.S. Cl.
CPC ..... *H04R 5/033* (2013.01); *H04R 5/04* (2013.01)

(58) Field of Classification Search
CPC . H04R 5/00; H04R 5/033; H04R 5/04; H04R 1/10; H04R 2420/03
(Continued)

(56) References Cited

U.S. PATENT DOCUMENTS 7,907,736 B2 * 3/2011 Yuen ..... H04S 1/005 381/1
8,515,084 B2 * 8/2013 Barr ..... H03G 11/00 381/55

(Continued)

FOREIGN PATENT DOCUMENTS

CN 103096216 A 5/2013
CN 203167245 U 8/2013

*Primary Examiner* — Xu Mei
(74) *Attorney, Agent, or Firm* — Womble Bond Dickinson (US) LLP

(57) ABSTRACT

Embodiments of this application provide an audio playback circuit and a terminal. The audio playback circuit includes: a first current path, configured to shunt a current output by a left-channel circuit to adjust a second voltage fed back to a first end of a right-channel headset when the left-channel circuit outputs a left-channel audio signal, where when the left-channel circuit outputs the left-channel audio signal and a right-channel circuit does not output a right-channel audio signal, the second voltage is equal to a voltage at a second end of a right-channel headset; and a second current path, configured to shunt a current output by the right-channel circuit to adjust a first voltage fed back to a first end of a left-channel headset when the right-channel circuit outputs the right-channel audio signal. The audio playback circuit in the embodiments of this application can improve isolation between a left channel and a right channel.

16 Claims, 9 Drawing Sheets

(58) Field of Classification Search
USPC ..... 381/26, 74, 309; 455/575.2
See application file for complete search history.

(56) References Cited

U.S. PATENT DOCUMENTS

| | | | | |
|---|---|---|---|---|
| 8,526,629 | B2 * | 9/2013 | Li | H04S 1/005 381/74 |
| 10,524,041 | B1 * | 12/2019 | Lin | H04R 3/007 |
| 2006/0222185 | A1 * | 10/2006 | Dyer | H04R 29/001 381/74 |
| 2009/0180640 | A1 * | 7/2009 | Ogawa | H03F 3/183 381/74 |

* cited by examiner

AUDIO PLAYBACK CIRCUIT AND TERMINAL

TECHNICAL FIELD

This application relates to the field of communications technologies, and in particular, to an audio playback circuit and a terminal.

BACKGROUND

When a terminal plays stereo audio, a playback loop of a left channel and a playback loop of a right channel play the stereo audio independently. The left channel and the right channel may play the stereo audio at different times, or may play the stereo audio at the same time. To ensure that the left channel and the right channel play the stereo audio independently without affecting each other, an isolation problem needs to be considered; that is, the playback loops of the two channels need to be isolated from each other, so as to avoid impact between the left channel and the right channel when the left channel and the right channel play sounds.

Two headsets of the two channels are usually connected to a common ground point. The common ground point needs to be connected to the sound source ground on the motherboard, but there is a wiring impedance, a magnetic-bead impedance, and the like between the common ground point and the sound source ground on the motherboard. Therefore, when the playback loop of a channel receives a signal from a processor whose absolute value of voltage is greater than that of a signal from the sound source ground on the motherboard, because of the wiring impedance, the magnetic-bead impedance, and the like, there is a voltage difference between the common ground point and the sound source ground one the motherboard. The voltage difference causes a current to flow through the headset of the other channel, so that the sound is played on the other channel, and isolation between the left channel and the right channel is poor.

SUMMARY

This application discloses an audio playback circuit and a terminal, so as to improve isolation between a left channel and a right channel.

According to a first aspect, an embodiment of this application provides an audio playback circuit. The audio playback circuit includes a left-channel circuit, a right-channel circuit, a first feedback circuit, a second feedback circuit, a first current path, and a second current path, where: an output end of the left-channel circuit is coupled to a first end of a left-channel headset, an input end of the first feedback circuit is coupled to a second end of the left-channel headset, and an output end of the first feedback circuit is coupled to an input end of the left-channel circuit; an output end of the right-channel circuit is coupled to a first end of a right-channel headset, an input end of the second feedback circuit is coupled to a second end of the right-channel headset, and an output end of the second feedback circuit is coupled to an input end of the right-channel circuit, where the second end of the left-channel headset is coupled to the second end of the right-channel headset; a first end of the first current path is coupled to the output end of the left-channel circuit and the first end of the left-channel headset, and a second end of the first current path is coupled to the input end of the second feedback circuit and the second end of the left-channel headset; a first end of the second current path is coupled to the output end of the right-channel circuit and the first end of the right-channel headset, and a second end of the second current path is coupled to the input end of the first feedback circuit and the second end of the right-channel headset; the left-channel circuit is configured to output a left-channel audio signal to the first end of the left-channel headset; the right-channel circuit is configured to output a right-channel audio signal to the first end of the right-channel headset; the first feedback circuit is configured to feed back a first voltage to the first end of the left-channel headset through the left-channel circuit when the right-channel circuit outputs the right-channel audio signal; the second feedback circuit is configured to feed back a second voltage to the first end of the right-channel headset through the right-channel circuit when the left-channel circuit outputs the left-channel audio signal; the first current path is configured to shunt a current output by the left-channel circuit to adjust the second voltage fed back to the first end of the right-channel headset when the left-channel circuit outputs the left-channel audio signal, where when the left-channel circuit outputs the left-channel audio signal and the right-channel circuit does not output the right-channel audio signal, the second voltage is equal to a voltage at the second end of the right-channel headset; and the second current path is configured to shunt a current output by the right-channel circuit to adjust the first voltage fed back to the first end of the left-channel headset when the right-channel circuit outputs the right-channel audio signal, where when the right-channel circuit outputs the right-channel audio signal and the left-channel circuit does not output the left-channel audio signal, the first voltage is equal to a voltage at the second end of the left-channel headset.

According to the audio playback circuit, when an absolute value of a voltage of a signal received by the left-channel playback loop from a processor is greater than that of a signal received by the sound source ground on the motherboard, and when a voltage of a signal received by the right-channel playback loop from the processor is equal to that of a signal from the sound source ground on the motherboard, the first current path is used to adjust a voltage fed back to a signal input end of the right-channel headset, so that voltages at both ends of the right-channel headset are equal when the right-channel playback loop is in the non-playing state, thereby reducing impact of current on the right-channel headset when the left-channel playback loop is playing. Similarly, when an absolute value of a voltage of a signal received by the right-channel playback loop from the processor is greater than that of the signal from the sound source ground on the motherboard, the second current path is used to change the voltage fed back to the signal input end of the left-channel headset, so that voltages at both ends of the left-channel headset are equal when the left-channel playback loop is in the non-playing state, thereby reducing impact of current on the left-channel headset when the right-channel playback loop is playing. It can be learned that crosstalk between the left channel and the right channel can be reduced by using the current path, so that the isolation between the left channel and the right channel is improved.

Coupling refers to transfer of energy from one part of a circuit to another part of the circuit. The coupling may be based on a wiring connection, or may be based on an electronic component or based on a circuit connection.

That a circuit of a channel outputs an audio signal of the channel may mean that an absolute value of a voltage of a signal received by the circuit of the channel from the processor is greater than that of a signal from the sound source ground on the motherboard. Tat a circuit of a channel does not output an audio signal of the channel may mean that a voltage of a signal received by the circuit of the channel from the processor is equal to that of the sound source ground on the motherboard.

During specific implementation, both the first feedback circuit and the second feedback circuit may be voltage feedback circuits.

In a possible implementation, the first current path includes a first impedance, where a first end of the first impedance is coupled to the output end of the left-channel circuit and the first end of the left-channel headset, and a second end of the first impedance is coupled to the input end of the second feedback circuit and the second end of the left-channel headset; and the second current path includes a second impedance, where a first end of the second impedance is coupled to the output end of the right-channel circuit and the first end of the right-channel headset, and a second end of the second impedance is coupled to the input end of the first feedback circuit and the second end of the right-channel headset.

In a possible implementation, the left-channel circuit, the right-channel circuit, the first feedback circuit, and the second feedback circuit are integrated in an audio chip; the first current path is coupled to the output end of the left-channel circuit and the input end of the second feedback circuit through a chip interface of the audio chip, the output end of the left-channel circuit is coupled to the first end of the left-channel headset through the chip interface of the audio chip, and the input end of the first feedback circuit is coupled to the second end of the left-channel headset through the chip interface of the audio chip; and the second current path is coupled to the output end of the right-channel circuit and the input end of the first feedback circuit through the chip interface of the audio chip, the output end of the right-channel circuit is coupled to the first end of the right-channel headset through the chip interface of the audio chip, and the input end of the second feedback circuit is coupled to the second end of the right-channel headset through the chip interface of the audio chip.

It can be learned that crosstalk between the right-channel playback loop and the left-channel playback loop can be reduced by using the chip interface of the audio chip without changing an internal structure of the audio chip through the first current path and the second current path, so that isolation between the right-channel playback loop and the left-channel playback loop is improved.

In a possible implementation, the left-channel circuit, the right-channel circuit, the first feedback circuit, the second feedback circuit, the first current path, and the second current path are integrated in an audio chip; the output end of the left-channel circuit is coupled to the first end of the left-channel headset through a chip interface of the audio chip, and the input end of the first feedback circuit is coupled to the second end of the left-channel headset through the chip interface of the audio chip; and the output end of the right-channel circuit is coupled to the first end of the right-channel headset through the chip interface of the audio chip, and the input end of the second feedback circuit is coupled to the second end of the right-channel headset through the chip interface of the audio chip.

In a possible implementation, the output end of the left-channel circuit is coupled to the first end of the left-channel headset through the headset interface, and the output end of the right-channel circuit is coupled to the first end of the right-channel headset through the headset interface, where an equivalent impedance generated between the headset interface and a stereo headset is a first equivalent impedance Rx, and the stereo headset includes the left-channel headset and the right-channel headset; the input end of the first feedback circuit is coupled to the second end of the left-channel headset through the headset interface, and the input end of the second feedback circuit is coupled to the second end of the right-channel headset through the headset interface, where an equivalent impedance generated between the headset interface and the feedback circuit is a second equivalent impedance Ry, and the feedback circuit includes the first feedback circuit and the second feedback circuit; and a sound source ground is coupled to the second end of the left-channel headset and the second end of the right-channel headset through the headset interface, where an equivalent impedance generated by the headset interface coupled to the sound source ground is a third equivalent impedance Re, and a voltage of the sound source ground is a reference voltage when the left-channel circuit or the right-channel does not output an audio signal.

The sound source ground is the sound source ground on the motherboard. The sound source ground on the motherboard refers to a reference voltage of a sound signal, where the reference voltage may come from a processor on the motherboard. A chip and a device may be provided on the motherboard. The chip may include, for example, an audio chip; and the device may include, for example, a device constituting a current path.

In a possible implementation, a value of the first impedance is as follows:

$$Rrfb = \frac{(Rr + Rx) * (Ry - x1 * \mathrm{Re} + \mathrm{Re})}{(x1 - 1) * \mathrm{Re} + x1 * Rx} - Ry$$

where Rrfb is the value of the first impedance; Rr is an equivalent impedance of the right-channel headset; and 1/x1 is a product of an amplification factor of the left-channel circuit and an amplification factor of the first feedback circuit; and a value of the second impedance is as follows:

$$Rlfb = \frac{(Rl + Rx) * (Ry - x2 * \mathrm{Re} + \mathrm{Re})}{(x2 - 1) * \mathrm{Re} + x2 * Rx} - Ry$$

where Rlfb is the value of the second impedance; Rl is an equivalent impedance of the left-channel headset; and 1/x2 is a product of an amplification factor of the right-channel circuit and an amplification factor of the second feedback circuit.

During specific implementation, when x1=1, Rrfb=Rr*Ry/Rx.

During specific implementation, when x2=1, Rlfb=Rl*Ry/Rx.

With the impedance Rrfb, when the signal received by the left-channel circuit from the processor is a signal from the sound source ground on the motherboard, the voltages at both ends of the left-channel headset are equal. Therefore, when the absolute value of the voltage of the signal received by the right-channel circuit from the processor is greater than that of the signal from the sound source ground on the motherboard, and the signal received by the left-channel circuit from the processor is a signal from the sound source ground on the motherboard, the voltage difference between the two ends of the left-channel headset is further reduced, so that crosstalk of the right-channel playback loop to the left-channel playback loop is reduced.

With the value of the impedance Rrfb, when the absolute value of the voltage of the signal received by the left-channel circuit from the processor is greater than that of the signal from the sound source ground on the motherboard, and the signal received by the right-channel circuit from the processor is a signal from the sound source ground on the motherboard, the voltages at both ends of the right-channel headset are equal. Therefore, when the absolute value of the voltage of the signal received by the left-channel circuit from the processor is greater than that of the signal from the sound source ground on the motherboard, and the signal received by the right-channel circuit from the processor is a signal from the sound source ground on the motherboard, the voltage difference between the two ends of the right-channel headset is further reduced, so that crosstalk of the left-channel playback loop to the right-channel playback loop is reduced. In this way, the isolation between the right-channel playback loop and the left-channel playback loop is improved.

According to a second aspect, an embodiment of this application provides an audio playback circuit. where the audio playback circuit includes a left-channel circuit, a right-channel circuit, and a third current path, where: an output end of the left-channel circuit is configured to couple to a first end of a left-channel headset, an output end of the right-channel circuit is configured to couple to a first end of a right-channel headset, and a second end of the left-channel headset is coupled to a second end of the right-channel headset; the left-channel circuit is configured to output a left-channel audio signal to the first end of the left-channel headset;

the right-channel circuit is configured to output a right-channel audio signal to the first end of the right-channel headset; a first end of the third current path is coupled to the output end of the left-channel circuit and the first end of the left-channel headset, and a second end of the third current path is coupled to the output end of the right-channel circuit and the first end of the right-channel headset; the third current path is configured to shunt a current output by the left-channel circuit to adjust a third voltage input to the first end of the right-channel headset when the left-channel circuit outputs a left-channel audio signal, where when the left-channel circuit outputs the left-channel audio signal and the right-channel circuit does not output the right-channel audio signal, the third voltage is equal to a voltage at the second end of the right-channel headset; and the third current path is further configured to shunt a current output by the right-channel circuit to adjust a fourth voltage input to the first end of the left-channel headset when the right-channel circuit outputs the right-channel audio signal, where when the right-channel circuit outputs the right-channel audio signal and the left-channel circuit does not output the left-channel audio signal, the fourth voltage is equal to a voltage at the second end of the left-channel headset.

With the audio playback circuit, when a signal received by the left-channel circuit from a processor is a signal from the sound source ground on the motherboard, a voltage at the input end of the left-channel headset is changed by using the third current path, so that the voltage value at the input end of the left-channel headset is equal to the voltage of the common ground point. Therefore, a voltage difference between the two ends of the left-channel headset is reduced, so that crosstalk of the right-channel playback loop to the left-channel playback loop is reduced. When the absolute value of the voltage of the signal received by the right-channel circuit from the processor is greater than that of the signal from the sound source ground on the motherboard, and the signal received by the left-channel circuit from the processor is a signal from the sound source ground on the motherboard, the third current path is used to make the voltages at both ends of the left-channel headset equal. In this case, the voltage difference between the two ends of the left-channel headset can be reduced, so that the crosstalk of the right-channel playback loop to the left-channel playback loop is reduced.

In this embodiment of this application, current path 3 is the third current path. The equivalent impedance Rx is a first equivalent impedance, the equivalent impedance Ry is a second equivalent impedance, and the equivalent impedance Re is a third equivalent impedance.

During specific implementation, the equivalent ground impedance may also include a detection impedance used to detect whether the headset is inserted into a headset interface, and the equivalent ground impedance may also include another ground impedance connected to current path 3.

When the equivalent ground impedance includes only the feedback impedance in the left-channel circuit, the equivalent impedance Rb=R11+R13.

In a possible implementation, the third current path includes a third impedance, where a first end of the third impedance is coupled to the output end of the left-channel circuit and the first end of the left-channel headset, and a second end of the third impedance is coupled to the output end of the right-channel circuit and the first end of the right-channel headset.

In a possible implementation, the output end of the left-channel circuit is coupled to the first end of the left-channel headset through a headset interface, and the output end of the right-channel circuit is coupled to the first end of the right-channel headset through the headset interface, where an equivalent impedance generated between the headset interface and a stereo headset is a first equivalent impedance Rx, and the stereo headset includes the left-channel headset and the right-channel headset; and a sound source ground is coupled to the second end of the left-channel headset and the second end of the right-channel headset through the headset interface, where an equivalent impedance generated by the headset interface coupled to the sound source ground is a third equivalent impedance Re, and a voltage of the sound source ground is a voltage at the first end of the left-channel headset when the left-channel headset does not output the left-channel audio signal.

In a possible implementation, a value of the third impedance is as follows:

$$Rfb = \frac{Rb * Rr}{Rx + \mathrm{Re}} \text{ or } Rbf = \frac{Rb * Rl}{Rx + \mathrm{Re}}$$

where Rfb is the value of the third impedance; Rr is an equivalent impedance of the right-channel headset; Rl is an equivalent impedance of the left-channel headset; and Rb is an equivalent ground impedance, where the third current path is coupled to the sound source ground through the equivalent ground impedance.

Optionally, the feedback impedance Rfb may alternatively be determined based on both the equivalent impedance Rl of the left-channel headset and the equivalent impedance Rr of the right-channel headset.

During specific implementation, Rfb=Rb*Rc/(Rx+Re). Rc may be determined based on the equivalent impedance Rl of the left-channel headset and the equivalent impedance Rr of the right-channel headset.

During specific implementation, Rc may be an average of the equivalent impedance Rl of the left-channel headset and the equivalent impedance Rr of the right-channel headset.

Optionally, the left-channel circuit and the right-channel circuit are integrated in an audio chip; a first end of the third current path is coupled to an output end of the left-channel circuit through a chip interface of the audio chip, and the output end of the left-channel circuit is coupled to a first end of the left-channel headset through the chip interface of the audio chip; and a second end of the third current path is coupled to an output end of the right-channel circuit through the chip interface of the audio chip, and the output end of the right-channel circuit is coupled to the first end of the right-channel headset through the chip interface of the audio chip.

It can be learned that the crosstalk between the right-channel playback loop and the left-channel playback loop can be reduced by using the chip interface of the audio chip through the third current path without changing an internal structure of the audio chip, so that isolation between the right-channel playback loop and the left-channel playback loop is improved.

Optionally, the left-channel circuit, the right-channel circuit, and the third current path are integrated in an audio chip; and the output end of the left-channel circuit and the first end of the third current path are coupled to the input end of the left-channel headset through a chip interface of the audio chip. The output end of the right-channel circuit and the second end of the third current path are coupled to the input end of the right-channel headset through the chip interface of the audio chip.

According to a third aspect, an embodiment of this application provides a terminal, where the terminal includes a processor, an audio playback circuit, and a headset interface, where: the processor is coupled to an input end of the audio playback circuit, and the processor is configured to input an audio signal to the audio playback circuit; an output end of the audio playback circuit is coupled to the headset interface; the headset interface is configured to connect to an external stereo headset, where the stereo headset includes a left-channel headset and a right-channel headset; and the audio playback circuit is the audio playback circuit according to the first aspect or any possible implementation of the first aspect.

According to a fourth aspect, an embodiment of this application provides a terminal, where the terminal includes a processor, an audio playback circuit, and a headset interface, where: the processor is coupled to an input end of the audio playback circuit, and the processor is configured to input an audio signal to the audio playback circuit; an output end of the audio playback circuit is coupled to the headset interface; the headset interface is configured to connect an external stereo headset, where the stereo headset includes a left-channel headset and a right-channel headset; and the audio playback circuit is the audio playback circuit according to the second aspect or any possible implementation of the second aspect.

DESCRIPTION OF EMBODIMENTS

Figure 1A:
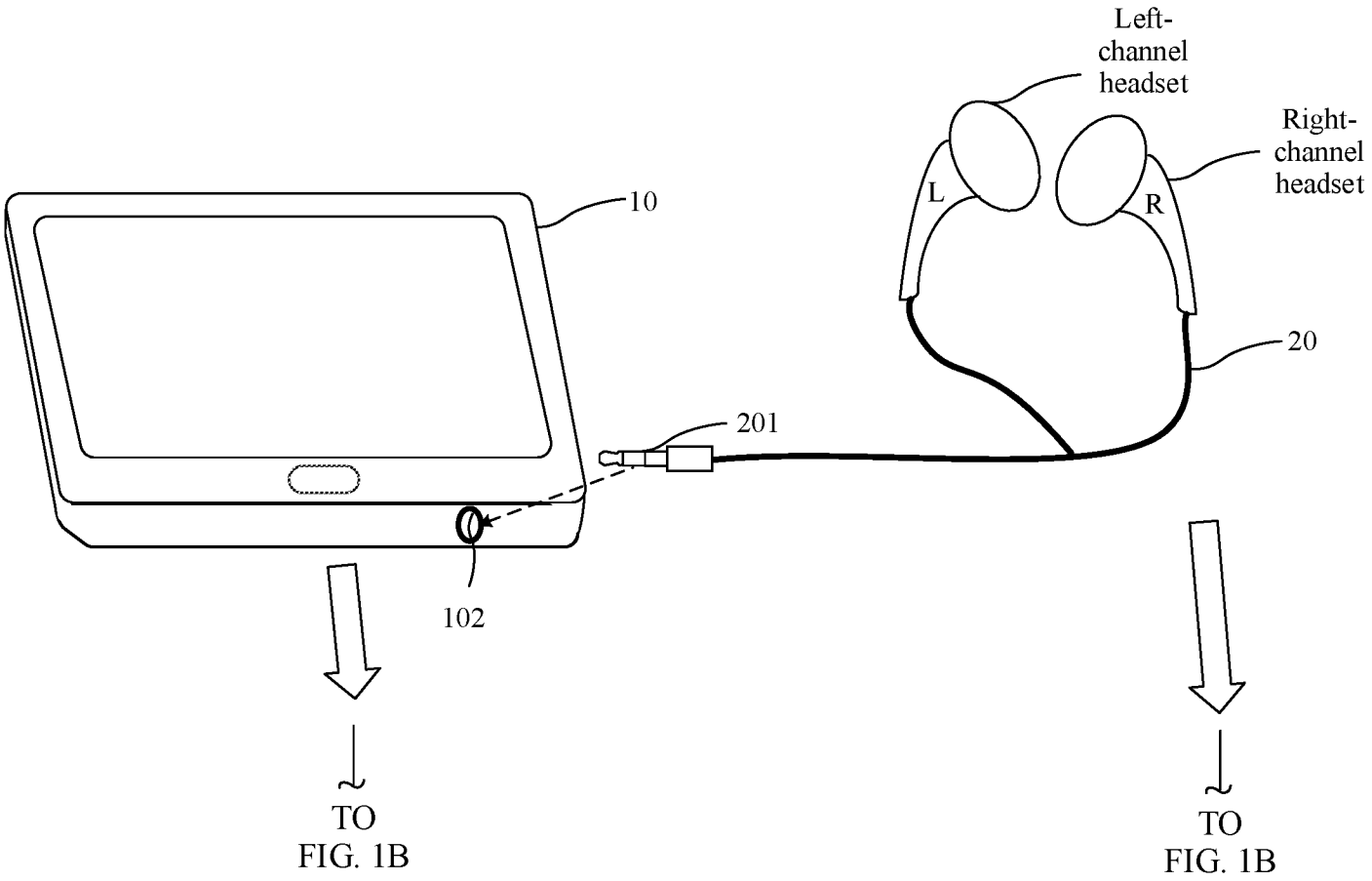
FIG. 1A and FIG. 1B are a schematic structural diagram of a sound playback system according to an embodiment of this application.

The following describes an application scenario and concepts used in embodiments of this application. In a stereo scenario, the left channel and the right channel play sounds independently. When a stereo sound is played by a terminal, a stereo headset and an audio chip may form a sound playback loop. The audio chip may be integrated in the terminal or may be a separate chip. The audio chip may be, for example, a coder-decoder (coder-decoder, CODEC) chip, and may be a high-fidelity (high-fidelity, HiFi) chip. The audio chip may support audio compression (coder) and decompression (decoder). The audio chip can compress and decompress audio using hardware, thereby saving CPU resources and improving the operation efficiency of the terminal. The audio chip used in the embodiments of this application may be a CODEC chip, a HiFi chip, another chip used for audio coding and decoding, or a future chip used for audio coding and decoding, which is not limited in the embodiments of this application.

The terminal may include a mobile phone, a tablet computer, a desktop computer, a mobile station (mobile station), a mobile unit (mobile unit), a radio unit, a remote unit, a user agent, a mobile client, an in-vehicle device, and the like that has an audio playback function. The stereo headset may be plugged into the headset interface of the terminal through a stereo headset plug, so as to connect to the audio chip in the terminal.

To facilitate an understanding of the embodiments of this application, some concepts or terms used in the embodiments of this application are described below.

(1) Headset Plug and Headset Interface

The stereo headset plug is a plug on the headset and may be of various types. For example, the stereo headset plug may be a 3.5 mm plug or a typeC plug. The headset interface is located on the terminal, and is configured to connect to an external headset plug. A 3.5 mm plug can match a 3.5 mm headset interface, and they can be connected to form to connect to form a closed sound playback loop. Similarly, the typeC plug may match the typeC headset interface, and they can be connected to form a closed sound playback loop.

In addition, when the headset interface and the headset plug are of different types, the headset adapter can be connected through a headset adapter cable. For example, when the headset interface is a typeC headset interface and the headset plug is a 3.5 mm plug, the 3.5 mm plug may be connected to the typeC plug using the headset adapter cable, and then the typeC plug on the headset adapter cable is connected to the typeC headset interface, so as to form the sound playback loop. For another example, when the headset interface is a 3.5 mm headset interface and the headset plug is a plug typeC plug, the typeC plug may be connected to the 3.5 mm plug using the headset adapter cable, and then the 3.5 mm plug on the headset adapter cable is connected to the 3.5 mm headset interface, so as to form the sound playback loop.

It can be understood that the foregoing examples of the types of the headset interface and the headset plug are not limited to the types of 3.5 mm and typeC, but may be extended to other headset interfaces and headset plugs. When the headset interface and the headset plug are of different types, they can be connected using the headset adapter cable, so as to form the sound playback loop.

Figure 3:
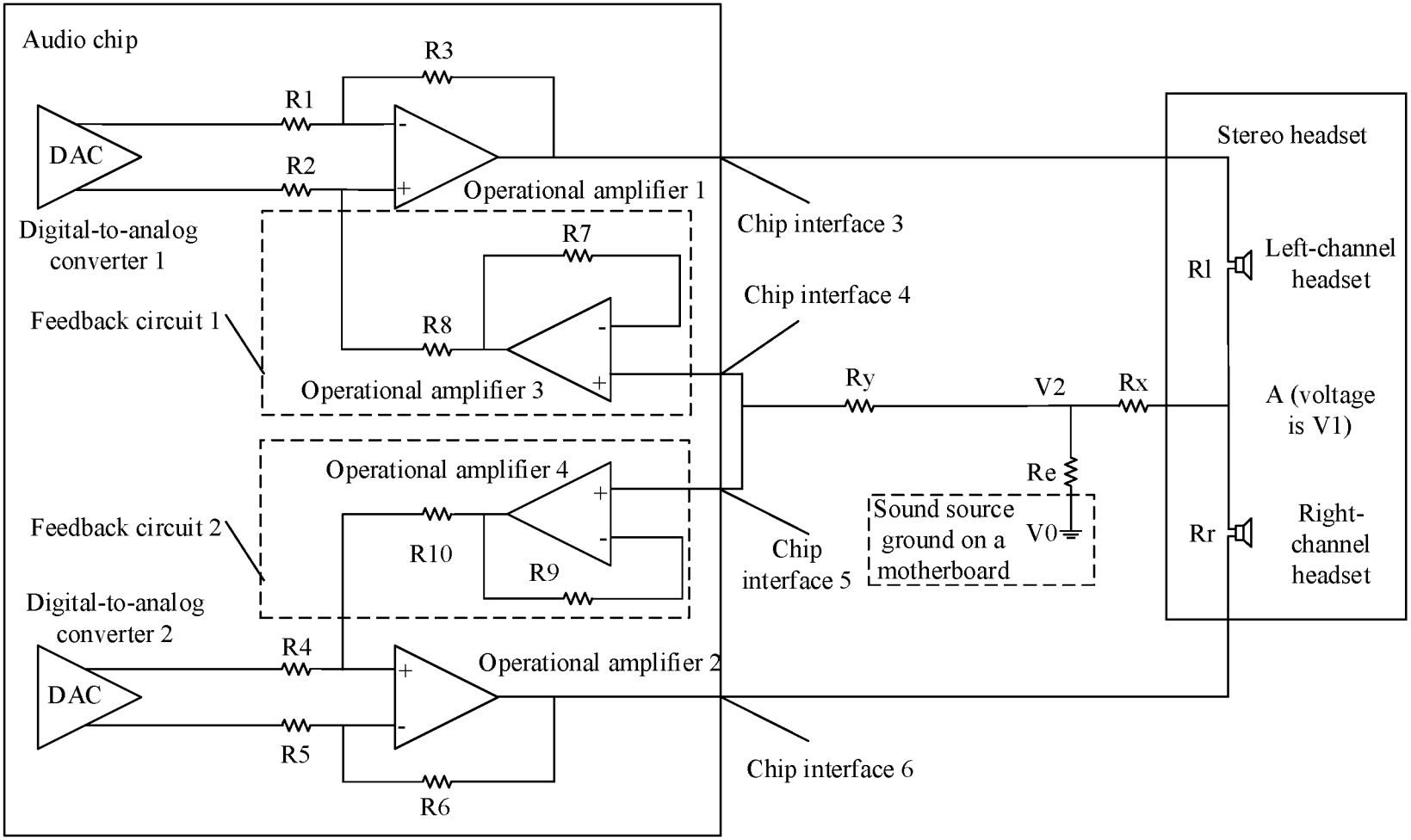
FIG. 3 is a schematic structural diagram of another sound playback system according to an embodiment of this application.

When the headset adapter cable is used to implement the adaptation function, the equivalent impedance between the common ground point of the two headsets and the sound source ground on the motherboard increases due to the contact impedance generated by the adaptation and the wiring impedance of the adapter cable, that is, the value of Rx in FIG. 3 is significantly increased due to the headset adapter cable.

The sound source ground on the motherboard refers to a reference voltage of a sound signal, where the reference voltage may come from a processor on the motherboard. A chip and a device may be provided on the motherboard. The chip may include, for example, an audio chip; and the device may include, for example, a device constituting a current path.

(2) Coupling Between Electronic Components and Coupling Between Circuits

Coupling reflects a connection relationship between electronic components, a connection relationship between an electronic component and a circuit, or a connection relationship between circuits. The electronic component may be, for example, a resistor, a capacitor, an inductor, or an amplifier. A circuit may be a plurality of electronic components connected using wires.

In the embodiments of this application, coupling refers to transfer of energy from one part of a circuit to another part of the circuit. For example, coupling between A and B may indicate that A and B are connected through wiring, or may indicate that A and B are connected using an electronic component or a circuit. Each of A and B may be a device or a circuit.

(3) Playing State and Non-Playing State of a Channel Playback Loop

In the embodiments of this application, a sound signal of a left channel can be input to a left-channel headset through a left-channel circuit, and a sound signal of a right channel can be input to a right-channel headset through a right-channel circuit. The left-channel circuit and the right-channel circuit may be included in an audio chip, and are used to receive a digital sound signal from a processor, and perform digital-to-analog conversion and amplification, and then transmit the obtained audio signal to the left-channel headset and the right-channel headset.

In the embodiments of this application, the non-playing state of a playback loop of a channel means that a signal received by the playback loop of the channel from the processor is a signal from the sound source ground on the motherboard. The playing state of a playback loop of a channel means that an absolute value of a voltage of a signal received by the playback loop of the channel from the processor is greater than that of a signal from the sound source ground on the motherboard.

In a playback loop of a channel, that the circuit of the channel outputs an audio signal of the channel may alternatively mean that an absolute value of a voltage of a signal received by the circuit of the channel from the processor is greater than that of a signal from the sound source ground on the motherboard. That a circuit of a channel does not output an audio signal of the channel may mean that a voltage of a signal received by the circuit of the channel from the processor is equal to that of the sound source ground on the motherboard. The voltage of the sound source ground on the motherboard is a reference voltage, that is, the voltage of the audio signal output by the processor when the left-channel circuit or the right-channel circuit does not output an audio signal. The circuit of a channel may include a left-channel circuit and a right-channel circuit. For detailed descriptions of the left-channel circuit and the right-channel circuit, reference may be made to detailed descriptions in the embodiment described later in FIG. 4, and details are not described herein again. For example, when the left-channel circuit outputs a left-channel audio signal, it indicates that a voltage of a signal received by the left-channel circuit from the processor is equal to that of a signal from the sound source ground on the motherboard. In the embodiments of this application, the sound source ground is the sound source ground on the motherboard.

Figure 1B:
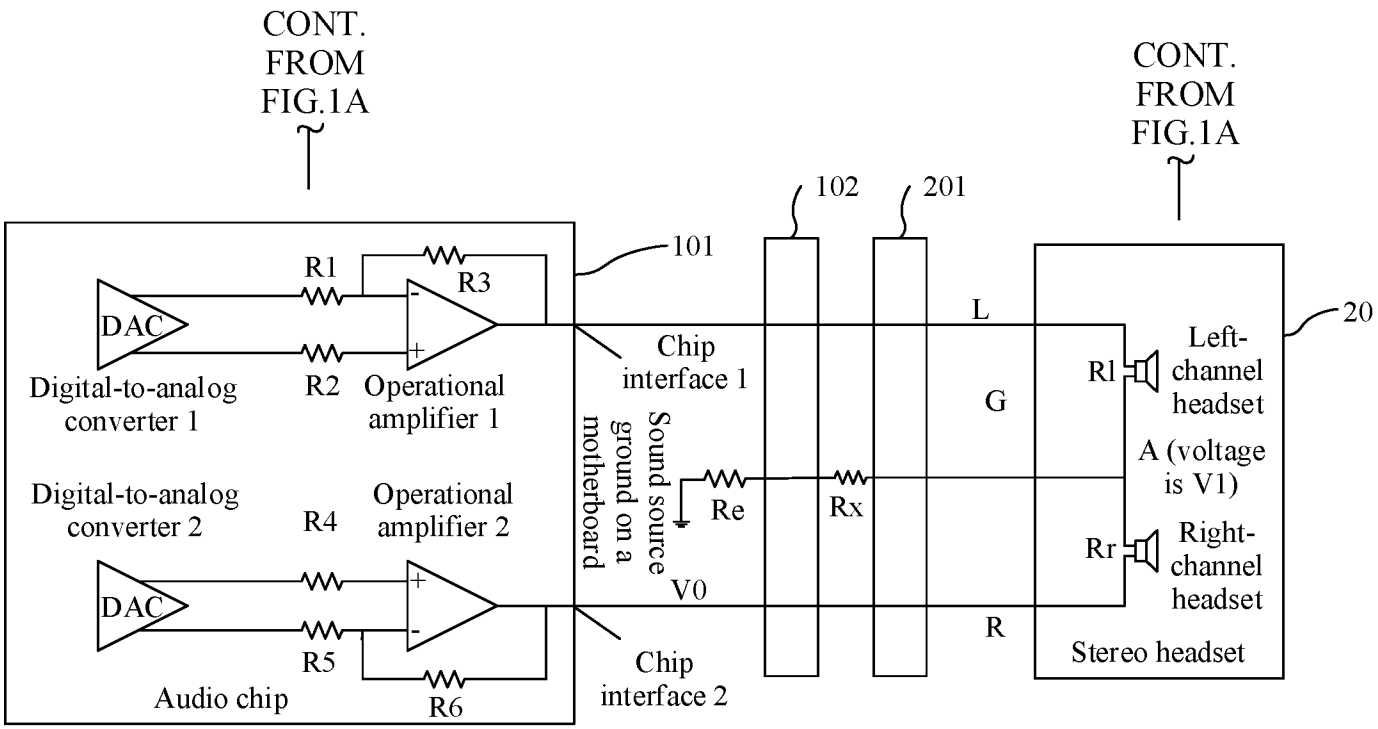

FIG. 1A and FIG. 1B are a schematic structural diagram of a sound playback system according to an embodiment of this application. As shown in FIG. 1A and FIG. 1B, the sound playback system includes a terminal 10 and a stereo headset 20. The terminal 10 may include an audio chip 101, and the terminal 10 provides an external headset interface 102 for connecting to the stereo headset 20 to form a sound playback loop. The stereo headset 20 includes a headset plug 201, where the headset plug 201 may be coupled to a left-channel headset and a right-channel headset and connected to the headset interface 102, so as to form a sound playback loop.

As shown in FIG. 1A and FIG. 1B, in the sound playback system, digital-to-analog converter 1, operational amplifier 1, an impedance R1, an impedance R2, and an impedance R3 that are of the audio chip 101, the left-channel headset, and the sound source ground on the motherboard form a left-channel playback loop through wires. Digital-to-analog converter 1 is configured to convert received digital left-channel audio data to an analog signal, where the digital left-channel audio data may come from a processor. Operational amplifier 1 is configured to output and amplify the analog signal output by digital-to-analog converter 1. The impedances R1 and R2 are configured to limit current, and the impedance R3 is configured to form a negative feedback loop of operational amplifier 1, so that the closed-loop gain of operational amplifier 1 tends to be stable, thereby eliminating impact of the open-loop gain of operational amplifier 1.

Similarly, as shown in FIG. 1A and FIG. 1B, in the sound playback system, digital-to-analog converter 2, operational amplifier 2, an impedance R4, an impedance R5, and an impedance R6 that are of the audio chip 101, the right-channel headset, and the sound source ground on the motherboard form a right-channel playback loop through wires. Digital-to-analog converter 2 is configured to convert the received digital right-channel audio data to an analog signal, and operational amplifier 2 is used to output and amplify the analog signal output by digital-to-analog converter 2. The impedances R4 and R5 are configured to limit current, and the impedance R6 is configured to form a negative feedback loop of operational amplifier 2, so that the closed-loop gain of operational amplifier 2 tends to be stable, thereby eliminating impact of the open-loop gain of operational amplifier 2.

As shown in FIG. 1A and FIG. 1B, the left-channel headset and the right-channel headset are grounded by a common ground point A that is on the headset plug 201 and that is connected to the sound source ground on the motherboard inside the terminal 10. The equivalent impedance Re generated by wiring or magnetic beads exists between a headset jack 102 and the sound source ground on the motherboard.

In the sound playback system, as shown in FIG. 1A and FIG. 1B, the audio chip includes a left-channel circuit and a right-channel circuit. The left-channel circuit includes a digital-to-analog converter 1, operational amplifier 1, an impedance R1, an impedance R2, and an impedance R3 that are connected through wiring, and the right-channel circuit includes digital-to-analog converter 2, operational amplifier 2, an impedance R4, an impedance R5, and an impedance R6 that are connected through wiring. The output end of the left-channel circuit in the audio chip may be provided through chip interface 1 of the audio chip, and the output end of the right-channel circuit may be provided through chip interface 2 of the audio chip. The stereo headset 20 may be provided with an interface to the audio chip through the headset interface 102 on the terminal. The stereo headset 20 is connected to the headset interface 102 on the terminal through a headset plug 201.

As shown in FIG. 1A and FIG. 1B, when an absolute value of a voltage of a signal received by the left-channel playback loop from the processor is greater than that of a signal from the sound source ground on the motherboard, a voltage V1 of the common ground point A is different from a voltage V0 of the sound source ground on the motherboard due to the equivalent impedance Re that is generated by wiring or magnetic beads and that exists between a headset jack and the sound source ground on the motherboard. When an absolute value of a voltage of a signal received by the right-channel playback loop from the processor is equal to that of the signal from the sound source ground on the motherboard, the voltage value of the signal input end of the right-channel headset is the voltage V0 of the sound source ground on the motherboard. That is, voltages at both ends of the right-channel headset are V0 and V1, and there is a voltage difference between the two ends of the right-channel headset, so that a current flows through the right-channel headset. That is, the sound playback of the left-channel headset affects the right-channel headset. Similarly, the playing state of the right-channel headset affects the left-channel headset, so that isolation between the left channel and the right channel is low.

The concepts of crosstalk and isolation used in the embodiments of this application are described below. The isolation may reflect the degree of crosstalk (crosstalk) between the left channel and the right channel. When the absolute value of the voltage of the signal received by one of the channels from the processor is greater than that of the sound source ground on the motherboard, and the voltage of the signal received by the other channel from the processor is that of the sound source ground on the motherboard, a difference between the voltages of the headsets of the two channels can be used as the isolation.

Figure 2:
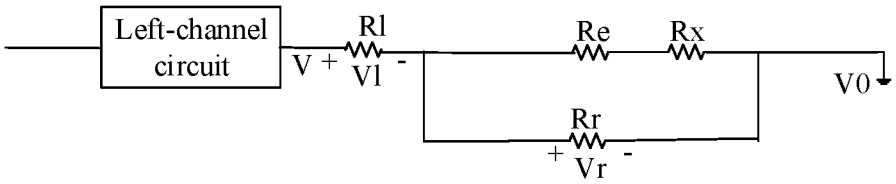
FIG. 2 is a schematic structural diagram of an equivalent circuit of a stereo headset according to an embodiment of this application.

When the voltage of the signal that is received by the input end of the left-channel headset and that undergoes analog-to-digital conversion and amplification is V, and the voltage of a signal received by the input end of the right-channel headset is the voltage V0 of the sound source ground on the motherboard, it is assumed that voltage values at both ends of the right-channel headset are Vr, and voltage values at both ends of the left-channel headset are Vl. In this case, reference may be made to FIG. 2. FIG. 2 is a schematic structural diagram of an equivalent circuit of a stereo headset according to an embodiment of this application, that is, the equivalent circuit of the stereo headset shown in FIG. 1A and FIG. 1B. As shown in FIG. 2, the following can be obtained according to Ohm's law:

$$\text{crosstalk} = 20\log_{10}\frac{Vr}{Vl} = 20\log_{10}\frac{Rr*(\text{Re}+Rx)}{Rl*(Rr+\text{Re}+Rx)} \tag{1}$$

When Rl=Rr, the following can be obtained according to formula (1):

$$\text{crosstalk} = 20\log_{10}\frac{\text{Re}+Rx}{Rr+\text{Re}+Rx} \tag{2}$$

where R is the equivalent impedance of the left-channel headset; Rr is the equivalent impedance of the right-channel headset; Re is the equivalent impedance that is generated by wiring or magnetic beads and that exists between the headset interface and the sound source ground on the motherboard, or the like; the equivalent impedance generated by the magnetic beads; and Rx includes one or more of the following: the contact impedance generated between the headset plug and the headset interface, the equivalent impedance that is generated by the wiring or magnetic beads between the headset and the headset plug, or the equivalent impedance generated by the headset adapter cable.

It can be learned that crosstalk is related to the equivalent impedance Rl of the left-channel headset, the equivalent impedance Rr of the right-channel headset, and Re+Rx, and is not related to the amplitude of the signal input to the audio chip. The smaller the sum of Re+Rx, the smaller the crosstalk between the left channel and the right channel, the better the isolation between the left channel and the right channel, and the stronger the stereoscopic sense of the sound output through the two headsets.

The isolation can be represented by an absolute value of crosstalk. The greater the absolute value of crosstalk, the greater the isolation between the left channel and the right channel, and the stronger the stereoscopic sense of the sound output through the two headsets.

FIG. 3 is a schematic structural diagram of another sound playback system according to an embodiment of this application. As shown in FIG. 3, the sound playback system is obtained by adding a feedback circuit to the sound playback system shown in FIG. 1A and FIG. 1B. Specifically, as shown in FIG. 3, feedback circuit 1 is added to a left-channel loop, and feedback circuit 2 is added to a right-channel loop. When an absolute value of a voltage of a signal received by the left-channel playback loop from a processor is greater than that of a signal from the sound source ground on the motherboard, a voltage V2 at the end of Rx is fed back to the input end of the right-channel headset through feedback circuit 2, thereby reducing the voltage difference between the two ends of the right-channel headset when a right-channel path is in the non-playing state. When an absolute value of a voltage of a signal received by the right-channel playback loop from the processor is greater than that of the signal from the sound source ground on the motherboard, the voltage V2 at the end of Rx is fed back to the input end of the left-channel headset through feedback circuit 1, thereby reducing the voltage difference between the two ends of the left-channel headset when the left-channel path is in the non-playing state.

Specifically, both feedback circuit 1 and feedback circuit 2 may be voltage feedback circuits. Feedback circuit 1 may include operational amplifier 3, an impedance R7, and an impedance R8. The impedance R8 is configured to limit current, and R7 and R8 may be configured to determine an amplification factor of amplifier 3. Feedback circuit 2 may include operational amplifier 4, an impedance R9, and an impedance R10. The impedance R10 is configured to limit current, and R9 and R10 may be configured to determine an amplification factor of operational amplifier 4.

Ry includes one or more of the following: an equivalent impedance generated by feedback wiring, or an equivalent impedance generated by magnetic beads. The feedback wiring may include wiring between the headset interface to the input end of feedback circuit 1 (or feedback circuit 2). Rx includes one or more of the following: the contact impedance generated between the headset plug and the headset interface, the equivalent impedance that is generated by wiring or magnetic beads and that exists between the headset and the headset plug, or the equivalent impedance that is generated by the headset adapter cable. For detailed descriptions of the left-channel playback loop and the right-channel playback loop, reference may be made to detailed descriptions in the embodiment described in FIG. 1A and FIG. 1B, and details are not described herein again.

The principle of reducing crosstalk between the left-channel playback loop and the right-channel playback loop using a feedback circuit is described in detail below.

When an absolute value of a voltage of a signal received by the left-channel playback loop from the processor is greater than that of a signal from the sound source ground on the motherboard, feedback circuit 2 feeds back the voltage V2 at the Rx end to the right-channel playback loop through voltage feedback, that is, transmits V2 to the right-channel headset through operational amplifier 2 and operational amplifier 4. If a product of an amplification factor of operational amplifier 2 and an amplification factor of operational amplifier 4 is 1/x2, the voltages at both ends of the right-channel headset are V2/x2 and V1 when the absolute value of the voltage of the signal received by the right-channel playback loop from the processor is equal to the voltage value of the signal from the sound source ground on the motherboard. When Rx is much smaller than the impedance Rl of the left-channel headset and the impedance Rr of the right-channel headset, V2/x2 and V1 are almost equal. This is because the partial voltage is positively related to an impedance, and almost all the voltage values of the signals from the processor fall on R1, and the partial voltage on Rx is negligible, that is, V1 is almost equal to V2. When the magnification factor 1/x2 is set to 1, V2/x2 and V1 are almost equal. That is, when the absolute value of the voltage of the signal received by the right-channel playback loop from the processor is equal to the voltage value of the voltage of the signal from the sound source ground on the motherboard, the current on the right-channel headset is approximately zero. Similarly, when the absolute value of the voltage of the signal received by the right-channel playback loop from the processor is greater than that of the signal from the sound source ground on the motherboard, the voltages at both ends of the left-channel headset are almost equal, so that impact between the two-channel playback sounds can be significantly reduced, thereby improving isolation between the left channel and the right channel.

In the sound playback system, as shown in FIG. 3, the audio chip includes a left-channel circuit and a right-channel circuit. The left-channel circuit includes a digital-to-analog converter 1, operational amplifier 1, an impedance R1, an impedance R2, and an impedance R3 that are connected through wiring, and the right-channel circuit includes digital-to-analog converter 2, operational amplifier 2, an impedance R4, an impedance R5, and an impedance R6 that are connected through wiring. The audio chip further includes feedback circuit 1 and feedback circuit 2. The output end of the left-channel circuit in the audio chip may be provided through chip interface 3 of the audio chip, and the feedback input end of feedback circuit 1 may be provided through chip interface 4 of the audio chip. The output end of the right-channel circuit may be provided through chip interface 6 of the audio chip, and the feedback input end of feedback circuit 2 may be provided through chip interface 5 of the audio chip. The stereo headset may be provided with an interface to the audio chip through the headset interface on the terminal, where the interface to the audio chip includes chip interface 3, chip interface 4, chip interface 5, and chip interface 6. The stereo headset is connected to the headset interface on the terminal through the headset plug.

However, in the sound playback system shown in FIG. 3, if Rx is not negligible relative to the impedance Rl of the left-channel headset and the impedance Rr of the right-channel headset, for example, Rx increases due to the headset adapter cable, a sound is generated on the headset of the other channel when one of the channel playback loops is playing, so that the isolation between the left channel and the right channel is reduced.

To improve the isolation between the left channel and the right channel, an embodiment of this application provides an audio playback circuit. The audio playback circuit may include a current path, where the current path may include a first current path and a second current path. One end of the first current path may be coupled to an output end of the left-channel circuit, and the other end of the first current path may be coupled to an input end of feedback path 2. One end of the second current path may be coupled to an output end of the right-channel circuit, and the other end of the second current path may be coupled to an input end of feedback path 1. When an absolute value of a voltage of a signal received by the left-channel playback loop from the processor is greater than that of a signal received by the sound source ground on the motherboard, and when a voltage of a signal received by the right-channel playback loop from the processor is equal to that of a signal from the sound source ground on the motherboard, the first current path is used to adjust a voltage fed back to a signal input end of the right-channel headset, so that the voltages at both ends of the right-channel headset are equal when the right-channel playback loop is in the non-playing state, thereby reducing impact of current on the right-channel headset when the left-channel playback loop is playing. Similarly, when an absolute value of a voltage of a signal received by the right-channel playback loop from the processor is greater than that of the signal from the sound source ground on the motherboard, the second current path is used to change the voltage fed back to the signal input end of the left-channel headset, so that the voltages at both ends of the left-channel headset are equal when the left-channel playback loop is in the non-playing state, thereby reducing impact of current on the left-channel headset when the right-channel playback loop is playing. It can be learned that the crosstalk between the left channel and the right channel can be reduced by using the current path, so that the isolation between the left channel and the right channel is improved.

Figure 4:
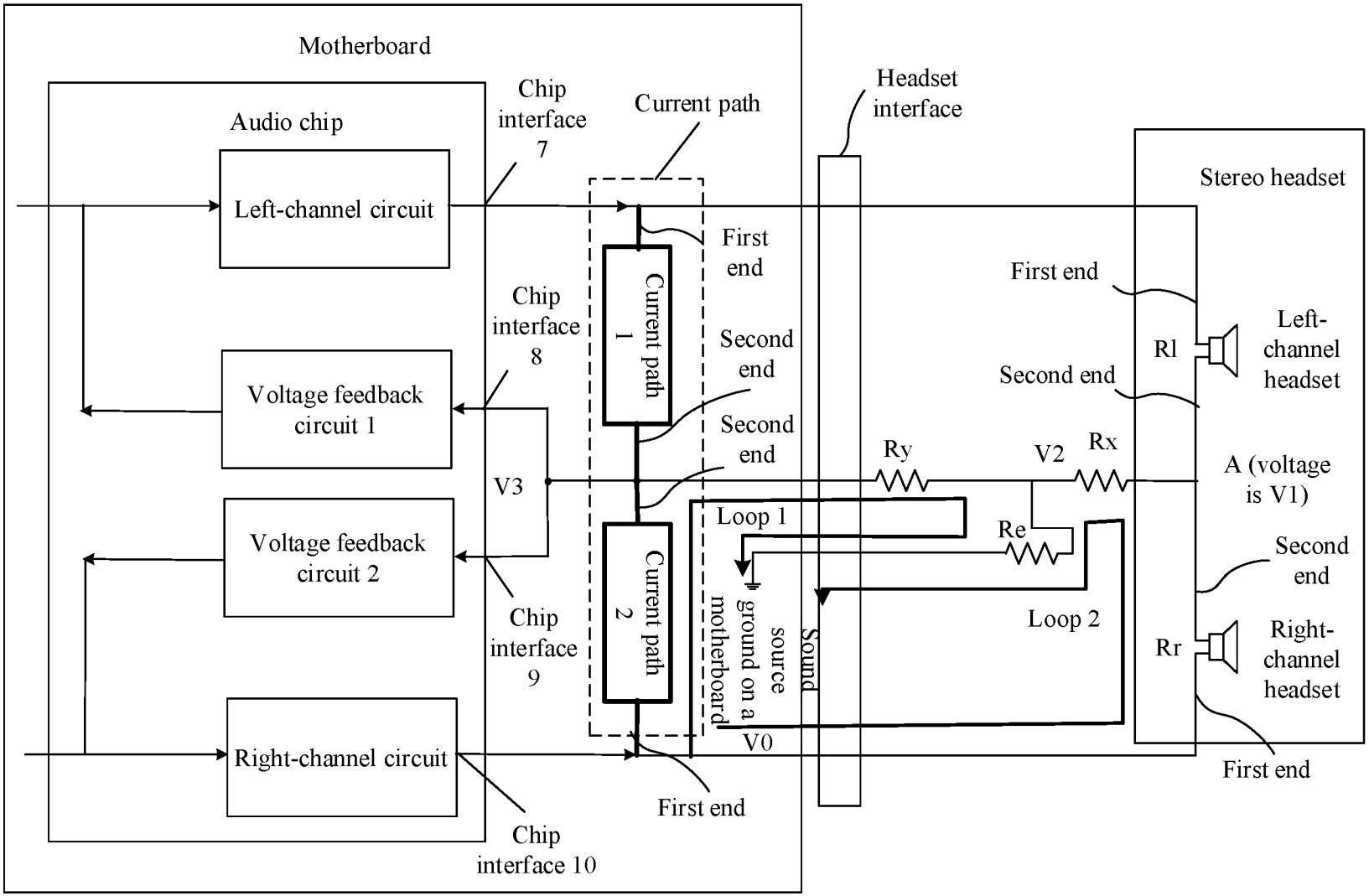
FIG. 4 is a schematic structural diagram of a sound playback system according to an embodiment of this application.

Specifically, reference may be made to FIG. 4. FIG. 4 is a schematic structural diagram of a sound playback system according to an embodiment of this application. As shown in FIG. 4, in the sound playback system, for the left-channel path, the left-channel circuit in the audio chip, the left-channel headset, and the sound source ground on the motherboard form a left-channel playback loop through wires. A voltage V3 at the end of impedance Ry is fed back to the input end of the left-channel circuit through voltage feedback circuit 1, where voltage feedback circuit 1 is configured to adjust the voltage input to the left-channel headset, and reduce the voltage difference between the two ends of the left-channel headset when the signal received by left-channel circuit from the processor is a signal from the sound source ground on the motherboard, so that crosstalk of the right-channel playback loop to the left-channel playback loop is reduced. For the right-channel path, similarly, the right-channel circuit in the audio chip, the right-channel headset, and the sound source ground on the motherboard form a right-channel playback loop through wires. The voltage V3 at the end of impedance Ry is fed back to the input end of the right-channel circuit through voltage feedback circuit 2, where voltage feedback circuit 2 is configured to the voltage input to the right-channel headset, and reduce the voltage difference between the two ends of the right-channel headset when the signal received by the right-channel circuit from the processor is a signal from the sound source ground on the motherboard, so that crosstalk of the left-channel playback loop to the right-channel playback loop is reduced. It can be learned that the isolation between the left channel and the right channel can be improved using voltage feedback circuit 1 and voltage feedback circuit 2.

In this embodiment of this application, current path 1 in the context is a first current path, and current path 2 is a second current path. Voltage feedback circuit 1 and feedback circuit 1 in the context are first feedback circuits, and voltage feedback circuit 2 and feedback circuit 2 are second feedback circuits. The equivalent impedance Rx is a first equivalent impedance, the equivalent impedance Ry is a second equivalent impedance, and the equivalent impedance Re is a third equivalent impedance.

As shown in FIG. 4, an output end of the left-channel circuit is coupled to a first end of the left-channel headset, an input end of the first feedback circuit is coupled to a second end of the left-channel headset, and an output end of the first feedback circuit is coupled to the input end of the left-channel circuit. An output end of the right-channel circuit is coupled to a first end of the right-channel headset, an input end of the second feedback circuit is coupled to a second end of the right-channel headset, and an output end of the second feedback circuit is coupled to the input end of the right-channel circuit. The second end of the left-channel headset is coupled to the second end of the right-channel headset.

As shown in FIG. 4, a first end of the first current path is coupled to the output end of the left-channel circuit and the first end of the left-channel headset, and a second end of the first current path is coupled to the input end of the second feedback circuit and the second end of the left-channel headset.

A first end of the second current path is coupled to the output end of the right-channel circuit and the first end of the right-channel headset, and a second end of the second current path is coupled to the input end of the first feedback circuit and the second end of the right-channel headset.

Functions of the modules in the audio playback circuit are described below.

The left-channel circuit is configured to output a left-channel audio signal to the first end of the left-channel headset.

The right-channel circuit is configured to output a right-channel audio signal to the first end of the right-channel headset.

The first feedback circuit is configured to feed back a first voltage to the first end of the left-channel headset through the left-channel circuit when the right-channel circuit outputs a right-channel audio signal.

The second feedback circuit is configured to feed back a second voltage through the right-channel circuit to the first end of the right-channel headset when the left-channel circuit outputs a left-channel audio signal.

The first current path is configured to shunt the current output by the left-channel circuit to adjust the second voltage fed back to the first end of the right-channel headset when the left-channel circuit outputs a left-channel audio signal. When the left-channel circuit outputs a left-channel audio signal and the right-channel circuit does not output a right-channel audio signal, the second voltage is equal to the voltage at the second end of the right-channel headset.

The second current path is configured to shunt the current output by the right-channel circuit to adjust the first voltage fed back to the first end of the left-channel headset when the right-channel circuit outputs a right-channel audio signal. When the right-channel circuit outputs a right-channel audio signal and the left-channel circuit does not output a left-channel audio signal, the first voltage is equal to the voltage at the second end of the left-channel headset.

Functions of current path 1 and current path 2 are described in detail below with reference to FIG. 4.

(1) Functions of current path 2 when the absolute value of the voltage of the signal received by the right-channel circuit from the processor is greater than that of the signal from the sound source ground on the motherboard, and the signal received by the left-channel circuit from the processor is a signal from the sound source ground on the motherboard For current path 2, when the absolute value of the voltage of the signal received by the right-channel circuit from the processor is greater than that of the signal from the sound source ground on the motherboard, and the signal received by the left-channel circuit from the processor is a signal from the sound source ground on the motherboard, because of the wiring impedance, the magnetic-bead impedance, or the equivalent impedance of the headset adapter cable, the voltage of the common ground point A of the right-channel headset and the left-channel headset is V1, which is greater than the ground voltage V0 of the sound source ground on the motherboard. The right-channel circuit forms a current loop through current path 2, the sound source ground on the motherboard, and the wires between current path 2 and the sound source ground on the motherboard, that is, loop 1 in FIG. 4, to change the voltage V3 fed back to the left-channel playback path. Loop 1 may change the voltage V3 fed back to the left-channel playback path by shunting the current on the right-channel circuit. The value of the impedance on current path 2 may be used to determine the voltage V3 fed back to the left-channel playback path. Therefore, the value of the impedance on current path 2 can be set so that the voltage fed back to the first end of the left-channel headset is V1. Therefore, when the absolute value of the voltage of the signal received by the right-channel circuit from the processor is greater than that of the signal from the sound source ground on the motherboard, and the signal received by the left-channel circuit from the processor is a signal from the sound source ground on the motherboard, the voltages at the first end and the second end of the left-channel headset are both equal to V1. A difference between the voltages at both ends of the left-channel headset is further reduced, so that the crosstalk of the right-channel playback loop to the left-channel playback loop is reduced. As shown in FIG. 4, loop 2 is a right-channel playback loop formed when the absolute value of the voltage of the signal received by the right-channel circuit from the processor is greater than that of the signal from the sound source ground on the motherboard.

(2) Functions of current path 1 when the absolute value of the voltage of the signal received by the left-channel circuit from the processor is greater than that of the signal from the sound source ground on the motherboard, and the signal received by the right-channel circuit from the processor is a signal from the sound source ground on the motherboard For current path 1, when the absolute value of the voltage of the signal received by the left-channel circuit from the processor is greater than that of the signal from the sound source ground on the motherboard, and the signal received by the right-channel circuit from the processor is a signal from the sound source ground on the motherboard, because of the wiring impedance, the magnetic-bead impedance, or the equivalent impedance of the headset adapter cable, the voltage of the common ground point A of the left-channel headset and the right-channel headset is V1, which is greater than the ground voltage V0 of the sound source ground on the motherboard. The left-channel circuit forms a current loop through current path 1, the sound source ground on the motherboard, and the wires between current path 1 and the sound source ground on the motherboard, to change the voltage V3 fed back to the right-channel playback path. A loop formed by connecting circuit path 1, impedances Ry and Rx, and the sound source ground on the motherboard to each other may change the voltage V3 fed back to the right-channel playback path by shunting the current on the left-channel circuit. The impedance value on current path 1 may be used to determine the voltage V3 fed back to the left-channel playback path. Therefore, the impedance value on current path 1 can be set so that the voltage fed back to the first end of the right-channel headset is V1. Therefore, when the absolute value of the voltage of the signal received by the left-channel circuit from the processor is greater than that of the signal from the sound source ground on the motherboard, and the signal received by the right-channel circuit from the processor is a signal from the sound source ground on the motherboard, the voltages at the first end and the second end of the right-channel headset are both equal to V1. A difference between the voltages at both ends of the right-channel headset is further reduced, so that the crosstalk of the left-channel playback loop to the right-channel playback loop is reduced.

In the sound playback system, as shown in FIG. 4, the audio chip includes a left-channel circuit, a right-channel circuit, voltage feedback circuit 1, and voltage feedback circuit 2. The output end of the left-channel circuit in the audio chip may be provided through chip interface 7 of the audio chip, and the feedback input end of voltage feedback circuit 1 may be provided through chip interface 8 of the audio chip. The output end of the right-channel circuit may be provided through chip interface 10 of the audio chip, and the feedback input end of feedback circuit 2 may be provided through chip interface 9 of the audio chip.

Both current path 1 and current path 2 may be provided on the motherboard of the terminal. A chip and a device may be provided on the motherboard. The chip may include, for example, an audio chip; and the device may include, for example, a device constituting a current path. As shown in FIG. 4, current path 1 is connected to the left-channel circuit through chip interface 7 of the audio chip, and is connected to voltage feedback circuit 1 through chip interface 8 of the audio chip. Current path 2 is connected to the right-channel circuit through chip interface 10 of the audio chip, and is connected to voltage feedback circuit 2 through chip interface 9 of the audio chip. The stereo headset may be provided with interfaces to the audio chip, the current path, and the sound source ground on the motherboard through the headset interface on the terminal, and the interface to the audio chip including chip interface 7, chip interface 8, chip interface 9, and chip interface 10. The stereo headset is connected to the headset interface on the terminal through the headset plug. The headset plug of the stereo headset may be connected to the headset interface of the terminal, so that the left-channel path is connected to the input end of the left-channel headset, the common ground point A is connected to the sound source ground on the motherboard through wiring, magnetic beads, or the like, the right-channel path is connected to the input end of the right-channel headset, and the common ground point A is connected to voltage feedback circuit 1 and voltage feedback circuit 2 through wiring, magnetic beads, or feedback wiring.

A specific implementation example of a left-channel circuit, a right-channel circuit, voltage feedback circuit 1, voltage feedback circuit 2, current path 1, and current path 2 in the sound playback system shown in FIG. 4 is provided below.

Figure 5:
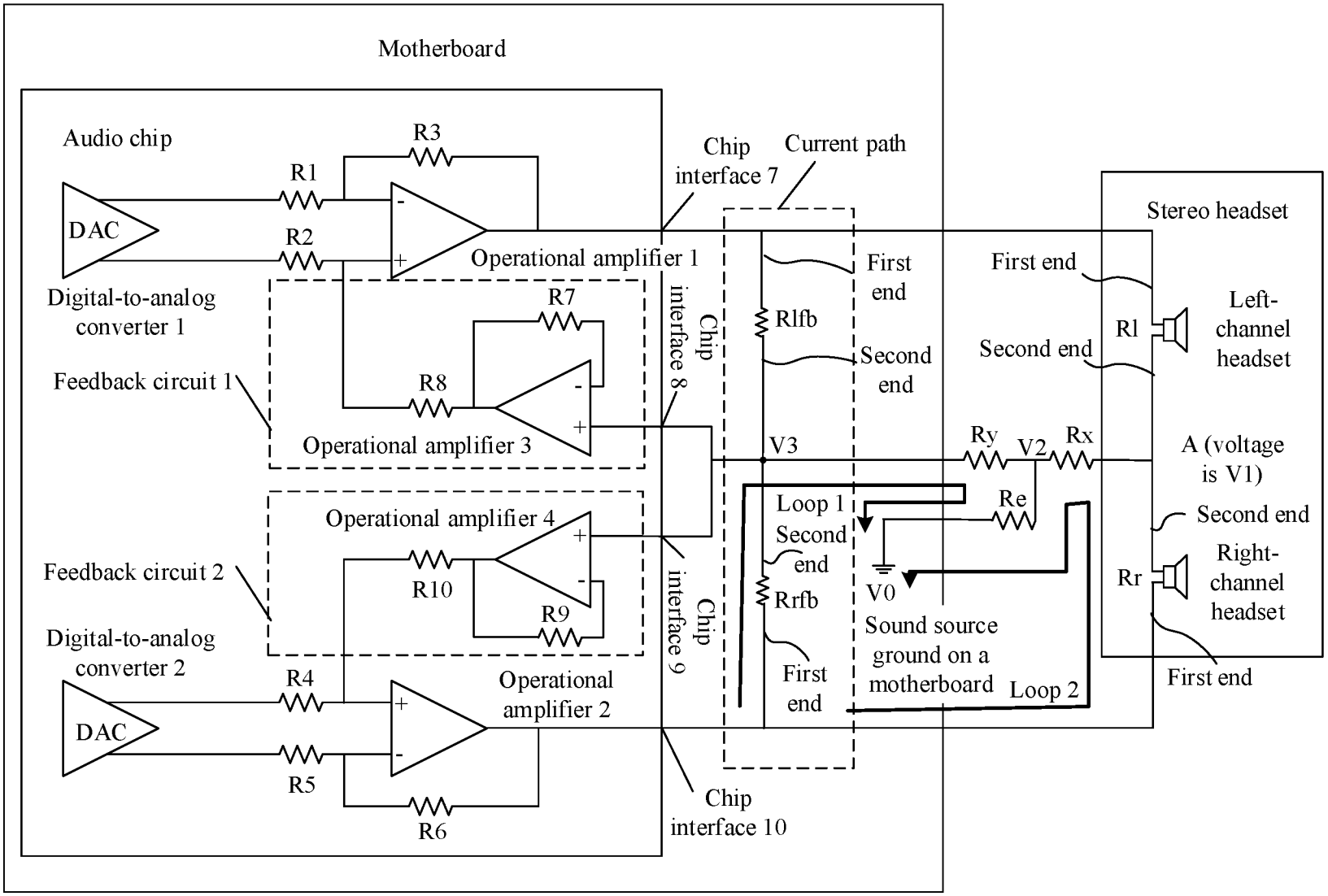
FIG. 5 is a schematic structural diagram of another sound playback system according to an embodiment of this application.

In this embodiment of this application, the left-channel circuit in the audio chip may be implemented using an operational amplifier and an impedance, and the right-channel circuit may be implemented using an operational amplifier and an impedance. Voltage feedback circuit 1 and voltage feedback circuit 2 may also be implemented using an operational amplifier and an impedance. Current path 1 and current path 2 may be implemented using an impedance. Specifically, reference may be made to FIG. 5. FIG. 5 is a schematic structural diagram of another sound playback system according to an embodiment of this application. It can be understood that specific structures that are of the left-channel circuit, the right-channel circuit, voltage feedback circuit 1, voltage feedback circuit 2, and the current path and that are shown in FIG. 5 are merely used to describe this embodiment of this application, and they may have other structures or variations. No limitation is imposed in this embodiment of this application.

As shown in FIG. 5, the first current path includes a first impedance. A first end of the first impedance is coupled to an output end of the left-channel circuit and a first end of the left-channel headset, and a second end of the first impedance is coupled to an input end of the second feedback circuit and a second end of the left-channel headset. The second current path includes a second impedance. A first end of the second impedance is coupled to an output end of the right-channel circuit and a first end of the right-channel headset, and a second end of the second impedance is coupled to an input end of the first feedback circuit and a second end of the right-channel headset.

As shown in FIG. 5, reference may be made to the left-channel playback loop and the right-channel playback loop in FIG. 1A and FIG. 1B and FIG. 3 with reference to the left-channel playback loop. For detailed descriptions of voltage feedback circuit 1 and voltage feedback circuit 2, reference may be made to detailed descriptions of feedback circuit 1 and feedback circuit 2 in FIG. 3, and details are not described herein again.

Functions of current path 1 and current path 2 exemplified in FIG. 5 are described below with reference to specific scenarios.

(a) Functions of Current Path 2

As shown in FIG. 5, current path 2 may be implemented using an impedance Rrfb. When the absolute value of the voltage of the signal received by the right-channel circuit from the processor is greater than that of the signal from the sound source ground on the motherboard, and the signal received by the left-channel circuit from the processor is a signal from the sound source ground on the motherboard, because of the wiring impedance, the bead impedance, or the equivalent impedance of the headset adapter cable, the voltage of the common ground point of the right-channel headset and the left-channel headset is V1. As shown in FIG. 5, when the absolute value of the voltage of the signal received by the right-channel circuit from the processor is greater than that of the signal from the sound source ground on the motherboard, and the signal received by the left-channel circuit from the processor is a signal from the sound source ground on the motherboard, two current loops are generated in the sound playback system: loop 1 and loop 2. Loop 1 is a current circuit formed by connecting a right-channel circuit, current path 2, and the sound source ground on the motherboard to each other. Loop 2 is a current loop formed by connecting the right-channel circuit, a right-channel headset, and the sound source ground on the motherboard to each other. Loop 1 may change the voltage V3 fed back to the left-channel playback path by shunting the current on the right-channel circuit. The impedance Rrfb on current path 2 may be used to determine the voltage V3 fed back to the left-channel playback path. Therefore, the voltage V3 fed back to the left-channel circuit can be set by setting the impedance Rrfb. Further, the impedance Rrfb is set so that the voltage at the first end of the feed-back circuit 1 and the voltage at the second end of the left-channel headset are equal to the voltage at the second end of the left-channel headset, that is, V1.

Figure 6:
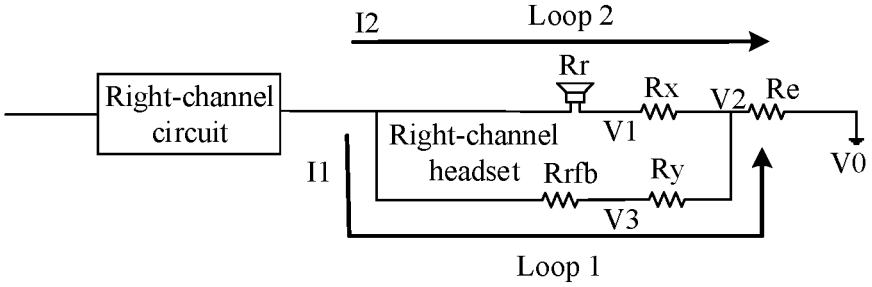
FIG. 6 is a schematic structural diagram of equivalent circuits of loop 1 and loop 2 according to an embodiment of this application.

Specifically, equivalent circuits of loop 1 and loop 2 shown in FIG. 5 are shown in FIG. 6. FIG. 6 is a schematic structural diagram of the equivalent circuits of loop 1 and loop 2 according to an embodiment of this application. The following describes how to determine a value of the impedance Rrfb so as to implement the following: When the right-channel playback loop is in the playing state and the left-channel path is in the non-playing state, the voltage value fed back to the first end of the left-channel headset is equal to V1.

As shown in FIG. 6, the voltage V3 between the impedances Rrfb and Ry in current path 2 is the voltage value fed back to the left-channel playback path, and the value of the voltage that is input to the left-channel headset after passing through operational amplifier 3 and operational amplifier 1 is equal to the voltage value of the common ground point, that is, V1. If a product of an amplification factor of operational amplifier 3 and an amplification factor of operational amplifier 1 is 1/x1, V3 is increased, that is:

$$V3 = x1 * V1 \tag{3}$$

Assuming that a current flowing through loop 1 is I1 and a current flowing through loop 2 is I2, the following can be obtained by using Ohm's law based on FIG. 6:

$$\begin{cases} I1 * (Rrfb + Ry) = I2 * (Rr + Rx) \\ V2 = (I1 + I2) * \mathrm{Re} \\ I1 * Ry = V3 - V2 \\ I2 * Rx = V1 - V2 \end{cases} \tag{4}$$

The following can be obtained according to formula (3) and formula (4):

$$Rrfb = \frac{(Rr + Rx) + (Ry - x1 * \mathrm{Re} + Rs)}{(x1 - 1) + \mathrm{Re} + x1 * Rx} - Ry \tag{5}$$

When x1=1, the following can be obtained according to formula (5):

$$Rrfb = \frac{Rr * Ry}{Rx} \tag{6}$$

According to formula (3), when the absolute value of the voltage of the signal received by the right-channel circuit from the processor is greater than that of the signal from the sound source ground on the motherboard, and the signal received by the left-channel circuit from the processor is a signal from the sound source ground on the motherboard, the voltage V3=x1*V1 is fed back to the input end of the left-channel headset through operational amplifier 3 and operational amplifier 1. After the voltage V3 passes through operational amplifier 3 and operational amplifier 1, the voltage input to the left-channel headset is V3/x1, that is, V1. The voltages at both ends of the left-channel headset are V1. Therefore, when the absolute value of the voltage of the signal received by the right-channel circuit from the processor is greater than that of the signal from the sound source ground on the motherboard, and the signal received by the left-channel circuit from the processor is a signal from the sound source ground on the motherboard, the voltage difference between the two ends of the left-channel headset is further reduced, so that crosstalk of the right-channel playback loop to the left-channel playback loop is reduced.

(b) Functions of Current Path 1

Similar to current path 2, the voltage V3 fed back to the right-channel playback path can be changed by shunting the current on the left-channel circuit through current path 1. An impedance Rlfb on current path 1 may be used to determine the voltage V3 fed back to the right-channel playback path. Therefore, the voltage V3 fed back to the right-channel circuit can be set by setting the impedance Rlfb. Further, the impedance Rlfb is set so that the voltage output to the first end of the right-channel headset after passing through feedback circuit 2 and the right-channel circuit is equal to the voltage output to the second end of the right-channel headset, that is, V1.

A method for determining an impedance Rrfb is similar to the method for determining the value of the impedance Rlfb. The value of the obtained impedance Rlfb can be used to implement the following: When the left-channel playback loop is in the playing state and the right-channel path is in the non-playing state, the voltage value fed back to the first end of the right-channel headset is equal to V1, that is, equal to the voltage at the second end of the right-channel headset.

If a product of an amplification factor of operational amplifier 4 and an amplification factor of operational amplifier 2 is 1/x2, the following can be obtained:

$$Rlfb = \frac{(Rl + Rx) * (Ry - x2 * \mathrm{Re} + \mathrm{Re})}{(x2 - 1) * \mathrm{Re} + x2 * Rx} - Ry \quad (7)$$

When x2=1, the following can be obtained according to formula (7):

$$Rlfb = \frac{Rl * Ry}{Rx} \quad (8)$$

According to formula (8), when the absolute value of the voltage of the signal received by the left-channel circuit from the processor is greater than that of the signal from the sound source ground on the motherboard, and the signal received by the right-channel circuit from the processor is a signal from the sound source ground on the motherboard, the voltage V3=x2*V1 is fed back to the input end of the right-channel headset through operational amplifier 4 and operational amplifier 2. After the voltage V3 passes through operational amplifier 4 and operational amplifier 2, a voltage input to the right-channel headset is V3/x2, that is, V1. The voltages at both ends of the right-channel headset are V1. Therefore, when the absolute value of the voltage of the signal received by the left-channel circuit from the processor is greater than that of the signal from the sound source ground on the motherboard, and the signal received by the right-channel circuit from the processor is a signal from the sound source ground on the motherboard, the voltage difference between the two ends of the right-channel headset is further reduced, so that crosstalk of the left-channel playback loop to the right-channel playback loop is reduced.

It can be learned that the crosstalk between the right-channel playback loop and the left-channel playback loop can be reduced by using the chip interface of the audio chip through the current path formed by Rrfb and Rlfb without changing an internal structure of the audio chip, so that isolation between the right-channel playback loop and the left-channel playback loop is improved.

In another possible embodiment, current path 1 and current path 2 shown in FIG. 5 may alternatively be integrated in an audio chip. The left-channel circuit is connected to the input end of the left-channel headset through a chip interface of the audio chip. The right-channel circuit is connected to the input end of the right-channel headset through the chip interface of the audio chip. Current path 1 and current path 2 are connected to the other end of Rx through the chip interface of the audio chip.

The stereo headset may be provided with interfaces to the audio chip, the current path, and the sound source ground on the motherboard through the headset interface on the terminal. The stereo headset is connected to the headset interface on the terminal through the headset plug.

In this embodiment of this application, Rlfb in current path 1 is a first impedance, and Rrfb in current path 2 is a second impedance. As shown in FIG. 5, a first end of the first impedance is coupled to an output end of the left-channel circuit, and a second end of the first impedance is coupled to an input end of the second feedback circuit. A first end of the second impedance is coupled to an output end of the right-channel circuit, and a second end of the second impedance is coupled to an input end of the first feedback circuit.

When the right-channel circuit outputs a right-channel audio signal, the voltage fed back by the first feedback circuit to the first end of the left-channel headset is a first voltage. When the absolute value of the voltage of the signal received by the right-channel circuit from the processor is greater than that of the signal from the sound source ground on the motherboard, and the signal received by the left-channel circuit from the processor is a signal from the sound source ground on the motherboard, the first voltage V3/x1 is equal to the voltage at the second end of the left-channel headset. When the left-channel circuit outputs a left-channel audio signal, the voltage fed back by the second feedback circuit to the first end of the right-channel headset is a second voltage. When the absolute value of the voltage of the signal received by the left-channel circuit from the processor is greater than that of the signal from the sound source ground on the motherboard, and the signal received by the right-channel circuit from the processor is a signal from the sound source ground on the motherboard, the second voltage V3/x2 is equal to the voltage at the second end of the right-channel headset.

Figure 7:
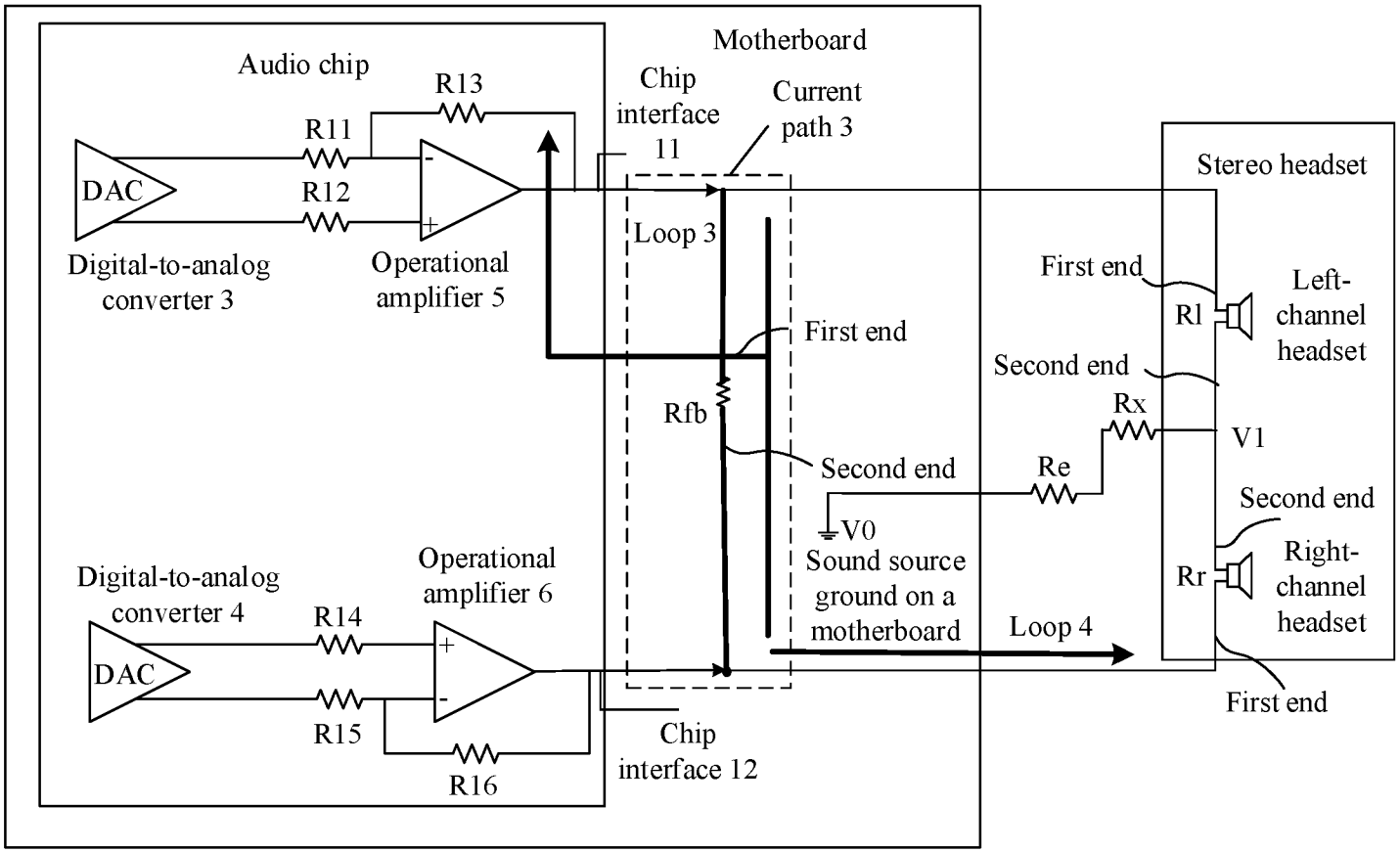
FIG. 7 is a schematic structural diagram of still another sound playback system according to an embodiment of this application.

In a possible implementation, the current path may be directly connected from the output end of the left-channel circuit to the output end of the right-channel circuit. FIG. 7 is a schematic structural diagram of another sound playback system according to an embodiment of this application. As shown in FIG. 7, in the sound playback system, for the left-channel path, the left-channel circuit in the audio chip, the left-channel headset, and the sound source ground on the motherboard form a left-channel playback loop through wires. When the absolute value of the voltage of the signal received by the right-channel circuit from the processor is greater than that of the signal from the sound source ground on the motherboard, and the signal received by the left-channel circuit from the processor is a signal from the sound source ground on the motherboard, the right-channel circuit forms a current loop through current path 3, that is, loop 3 in FIG. 7, to change the voltage fed back to the left-channel playback path.

In a possible implementation, as shown in FIG. 7, current path 3 may be implemented using a feedback impedance Rib.

Current path 3 is a third current path, and the feedback impedance Rfb is a third impedance. As shown in FIG. 7, the third current path includes a third impedance, where a first end of the third impedance is coupled to the output end of the left-channel circuit and the first end of the left-channel headset, and a second end of the third impedance is coupled to the output end of the right-channel circuit and the first end of the right-channel headset.

In a possible implementation, as shown in FIG. 7, the left-channel circuit may include digital-to-analog converter 3, operational amplifier 5, an impedance R11, an impedance R12, and an impedance R13 that are connected through wiring, and the right-channel circuit may include digital-to-analog converter 4, operational amplifier 6, and an impedance R14, an impedance R15, and an impedance R16 that are connected through wiring. For detailed descriptions of the left-channel circuit and the right-channel circuit, reference may be made to related descriptions in the embodiment described in FIG. 1A and FIG. 1B, and details are not described herein again.

It can be understood that the embodiment of this application is described based on the following case: Current path 3 is implemented using the feedback impedance Rfb, the left-channel circuit includes digital-to-analog converter 3, operational amplifier 5, and the impedance R11, the impedance R12, and the impedance R13 that are connected through wiring, and the right-channel circuit includes digital-to-analog converter 4, operational amplifier 6, the impedance R14, the impedance R15, and the impedance R16 that are connected through wiring. However, current path 3, the left-channel circuit, and the right-channel circuit shown in FIG. 7 are merely used to describe this embodiment of this application, and current path 3, the left-channel circuit, and the right-channel circuit may have other structures or variations. No limitation is imposed in this embodiment of this application.

In this embodiment of this application, current path 3 is the third current path. The equivalent impedance Rx is a first equivalent impedance, the equivalent impedance Ry is a second equivalent impedance, and the equivalent impedance Re is a third equivalent impedance. For descriptions of the equivalent impedances Rx, Ry and Re, reference may be made to detailed descriptions of the embodiments described in FIGS. 1 and 3, and details are not described herein again.

As shown in FIG. 4, the output end of the left-channel circuit is configured to couple to the first end of the left-channel headset, the output end of the right-channel circuit is configured to couple to the first end of the right-channel headset, and the second end of the left-channel headset is coupled to the second end of the right-channel headset. Functions of the modules in the audio playback circuit are described below.

The left-channel circuit is configured to output a left-channel audio signal to the first end of the left-channel headset.

The right-channel circuit is configured to output a right-channel audio signal to the first end of the right-channel headset.

The first end of the third current path is coupled to the output end of the left-channel circuit and the first end of the left-channel headset, and the second end of the third current path is coupled to the output end of the right-channel circuit and the first end of the right-channel headset.

The third current path is configured to shunt the current output by the left-channel circuit to adjust a third voltage input to the first end of the right-channel headset when the left-channel circuit outputs a left-channel audio signal. When the left-channel circuit outputs a left-channel audio signal and the right-channel circuit does not output a right-channel audio signal, the third voltage is equal to the voltage at the second end of the right-channel headset.

The third current path is further configured to shunt the current output by the right-channel circuit to adjust the fourth voltage input to the first end of the left-channel headset when the right-channel circuit outputs a right-channel audio signal. When the right-channel circuit outputs a right-channel audio signal and the left-channel circuit does not output a left-channel audio signal, the fourth voltage is equal to the voltage at the second end of the left-channel headset.

As shown in FIG. 7, when the absolute value of the voltage of the signal received by the right-channel circuit from the processor is greater than that of the signal from the sound source ground on the motherboard, and the signal received by the left-channel circuit from the processor is a signal from the sound source ground on the motherboard, two current loops are generated in the sound playback system: loop 3 and loop 4.

Loop 3 is a current loop that is formed by the right-channel circuit, current path 3, and an equivalent ground impedance through wiring. As shown in FIG. 7, the equivalent ground impedance may include the feedback impedances R11 and R13 in the left-channel circuit. In addition, the equivalent ground impedance may also include a detection impedance for detecting whether the headset is inserted into the headset interface, and the equivalent ground impedance may also include another ground impedance connected to current path 3. Loop 4 is a current loop formed by a right-channel circuit, a right-channel headset, and a sound source ground on the motherboard. When the absolute value of the voltage of the signal received by the right-channel circuit from the processor is greater than that of the signal from the sound source ground on the motherboard, and the signal received by the left-channel circuit from the processor is a signal from the sound source ground on the motherboard, loop 3 may change the voltage at the input end of the left-channel headset, so that the voltage at the input end of the left-channel headset is equal to the voltage at the common ground point, that is, V1. Therefore, the voltage difference between the two ends of the left-channel headset is reduced, so that crosstalk of the right-channel playback loop to the left-channel playback loop is reduced.

The following describes how to determine the value of the impedance Rfb so as to implement the following: When the right-channel playback loop is in the playing state and the left-channel path is in the non-playing state, the voltage value fed back to the first end of the left-channel headset is equal to V1; and when the left-channel playback loop is in the playing state and the right-channel path is in the non-playing state, the voltage value fed back to the first end of the right-channel headset is equal to V1.

Figure 8:
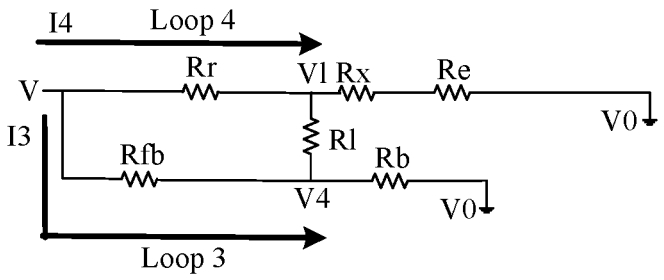
FIG. 8 is a schematic structural diagram of equivalent circuits of loop 3 and loop 4 according to an embodiment of this application.

Specifically, equivalent circuits of loop 3 and loop 4 shown in FIG. 7 are shown in FIG. 8. FIG. 8 is a schematic structural diagram of the equivalent circuits of loop 3 and loop 4 according to an embodiment of this application. The following can be obtained by using Ohm's law based on FIG. 8:

$$\begin{cases} V1 = I3 * Rfb = I4 * Rr \\ I3 * (Rfb + Rb) = I4 * (Rr + Rx + \mathrm{Re}) \end{cases} \tag{9}$$

where Rb is the equivalent ground impedance, and when the equivalent ground impedance includes only the feedback impedance in the left-channel circuit, as shown in FIG. 7, Rb=R11+R13.

The following can be obtained according to formula (9):

$$Rfb = \frac{Rb * Rr}{Rx + \mathrm{Re}} \tag{10}$$

When the absolute value of the voltage of the signal received by the right-channel circuit from the processor is greater than that of the signal from the sound source ground on the motherboard, and the signal received by the left-channel circuit from the processor is a signal from the sound source ground on the motherboard, it can be learned, according to formula (9), that the voltages at both ends of the left-channel headset are V1. In this case, the voltage difference between the two ends of the left-channel headset can be reduced, so that the crosstalk of the right-channel playback loop to the left-channel playback loop is reduced.

Similarly, the feedback impedance Rfb may also be expressed as:

$$Rfb = \frac{Rb * Rl}{Rx + \mathrm{Re}} \tag{11}$$

When the absolute value of the voltage of the signal received by the left-channel circuit from the processor is greater than that of the signal received by the sound source ground on the motherboard, and the signal received by the right-channel circuit from the processor is a signal from the sound source ground on the motherboard, the voltages at both ends of the right-channel headset that are obtained according to formula (11) are V1. In this case, the voltage difference between the two ends of the right-channel headset can be reduced, so that crosstalk of the left-channel playback loop to the right-channel playback loop is reduced.

Optionally, the feedback impedance Rib may alternatively be determined based on both the equivalent impedance Rl of the left-channel headset and the equivalent impedance Rr of the right-channel headset. The equivalent impedance R1 of the left-channel headset and the equivalent impedance Rr of the right-channel headset may be equal. In this case, formula (10) is the same as formula (11). The equivalent impedance Rl of the left-channel headset and the equivalent impedance Rr of the right-channel headset may alternatively be different. In this case, the feedback impedance Rfb may alternatively be expressed as:

$$Rfb = \frac{Rb * Rc}{Rx + \mathrm{Re}} \tag{12}$$

where Rc may be determined based on the equivalent impedance Rl of the left-channel headset and the equivalent impedance Rr of the right-channel headset, and during specific implementation, Rc may be an average of the equivalent impedance Rl of the left-channel headset and the equivalent impedance Rr of the right-channel headset.

Rfb in current path 3 is a third impedance. As shown in FIG. 7, a first end of the third impedance is coupled to an output end of the left-channel circuit, and a second end of the third impedance is coupled to an output end of the right-channel circuit.

When the absolute value of the voltage of the signal received by the right-channel circuit from the processor is greater than that of the signal from the sound source ground on the motherboard, and the signal received by the left-channel circuit from the processor is a signal from the sound source ground on the motherboard, the voltage at the first end of the left-channel headset is a fourth voltage V4. According to Ohm's law, with the third current path, the fourth voltage V4 is equal to the voltage V1 at the second end of the left-channel headset. When the absolute value of the voltage of the signal received by the left-channel circuit from the processor is greater than that of the signal from the sound source ground on the motherboard, and the signal received by the right-channel circuit from the processor is a signal from the sound source ground on the motherboard, the voltage at the first end of the right-channel headset is a third voltage. According to Ohm's law, the third voltage is equal to the voltage V1 at the second end of the right-channel headset.

In the sound playback system, as shown in FIG. 7, the audio chip includes a left-channel circuit and a right-channel circuit, the output end of the left-channel circuit in the audio chip may be provided through chip interface 11 of the audio chip, the output end of the right-channel circuit may be provided through chip interface 12 of the audio chip, and current path 3 is connected to the motherboard of the terminal through chip interface 11 and chip interface 12. The sound playback system can reduce crosstalk between the left-channel playback loop and the right-channel playback loop by using the chip interface of the audio chip without changing an internal structure of the audio chip, so that isolation between the left-channel playback loop and the right-channel playback loop is improved.

Figure 9:
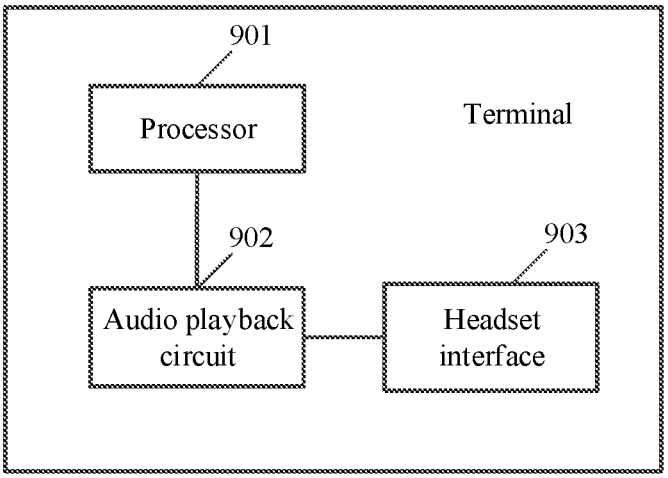
FIG. 9 is a schematic structural diagram of a terminal according to an embodiment of this application.

FIG. 9 is a schematic structural diagram of a terminal according to an embodiment of this application. The terminal may be the terminal 10 described in FIG. 1A and FIG. 1B. As shown in FIG. 9, the terminal includes a processor 901, an audio playback circuit 902, and a headset interface 903.

The processor 901 may be one or more central processing units (central processing unit, CPU). When the processor 901 is one CPU, the CPU may be a single-core CPU or a multi-core CPU.

The processor 901 is coupled to an input end of the audio playback circuit 902, and the processor 901 is configured to input an audio signal to the audio playback circuit 902.

An output end of the audio playback circuit 902 is coupled to the headset interface 903.

The headset interface 903 is configured to connect to an external stereo headset, where the stereo headset includes a left-channel headset and a right-channel headset. The headset interface 903 may be the headset interface 102 shown in FIG. 1A and FIG. 1B, or the headset interface may be a typeC headset interface or a 3.5 mm headset interface.

The stereo headset may be the stereo headset 20 described in FIG. 1A and FIG. 1B. The stereo headset may alternatively be the stereo headset described in any one of FIG. 3 to FIG. 7.

The audio playback circuit 902 may be the audio playback circuit described with reference to the previous embodiment of FIG. 4 or FIG. 5.

When an absolute value of a voltage of a signal received by the left-channel playback loop from a processor is greater than that of a signal received by the sound source ground on the motherboard, and when a voltage of a signal received by the right-channel playback loop from the processor is equal to that of a signal from the sound source ground on the motherboard, the first current path is used to adjust a voltage fed back to a signal input end of the right-channel headset, so that the voltages at both ends of the right-channel headset are equal when the right-channel playback loop is in the non-playing state, thereby reducing impact of current on the right-channel headset when the left-channel playback loop is playing. Similarly, when an absolute value of a voltage of a signal received by the right-channel playback loop from the processor is greater than that of the signal from the sound source ground on the motherboard, the second current path is used to change the voltage fed back to the signal input end of the left-channel headset, so that the voltages at both ends of the left-channel headset are equal when the left-channel playback loop is in the non-playing state, thereby reducing impact of current on the left-channel headset when the right-channel playback loop is playing. It can be learned that crosstalk between the left channel and the right channel can be reduced by using the current path, so that isolation between the left channel and the right channel is improved.

The audio playback circuit 902 may alternatively be an audio playback circuit described in the embodiment of FIG. 7.

When the absolute value of the voltage of the signal received by the right-channel circuit from the processor is greater than that of the signal from the sound source ground on the motherboard, and the signal received by the left-channel circuit from the processor is a signal from the sound source ground on the motherboard, the voltage at the first end of the left-channel headset is equal to the voltage at the second end of the left-channel headset. When the absolute value of the voltage of the signal received by the left-channel circuit from the processor is greater than that of the signal from the sound source ground on the motherboard, and the signal received by the right-channel circuit from the processor is a signal from the sound source ground on the motherboard, the voltage at the first end of the right-channel headset is equal to the voltage at the second end of the right-channel headset.

It should be noted that the terminal shown in FIG. 9 is only one implementation of this embodiment of this application. In actual application, the terminal shown in FIG. 9 may further include more or fewer components, which is not limited herein.

The foregoing descriptions are merely specific implementations of this application, but are not intended to limit the protection scope of this application. Any variation or replacement within the technical scope disclosed in this application shall fall within the protection scope of this application. Therefore, the protection scope of this application shall be subject to the protection scope of the claims.

What is claimed is:

1. An audio playback circuit, comprising a left-channel circuit, a right-channel circuit, a first feedback circuit, a second feedback circuit, a first current path, and a second current path, wherein:

an output end of the left-channel circuit is coupled to a first end of a left-channel headset, an input end of the first feedback circuit is coupled to a second end of the left-channel headset, and an output end of the first feedback circuit is coupled to an input end of the left-channel circuit;

an output end of the right-channel circuit is coupled to a first end of a right-channel headset, an input end of the second feedback circuit is coupled to a second end of the right-channel headset, and an output end of the second feedback circuit is coupled to an input end of the right-channel circuit, wherein the second end of the left-channel headset is coupled to the second end of the right-channel headset;

a first end of the first current path is coupled to the output end of the left-channel circuit and the first end of the left-channel headset, and a second end of the first current path is coupled to the input end of the second feedback circuit and the second end of the left-channel headset;

a first end of the second current path is coupled to the out put end of the right-channel circuit and the first end of the right-channel headset, and a second end of the second current path is coupled to the input end of the first feedback circuit and the second end of the right-channel headset;

the left-channel circuit is configured to output a left-channel audio signal to the first end of the left-channel headset;

the right-channel circuit is configured to out put a right-channel audio signal to the first end of the right-channel headset;

the first feedback circuit is configured to feed back a first voltage to the first end of the left-channel headset through the left-channel circuit when the right-channel circuit outputs the right-channel audio signal;

the second feedback circuit is configured to feed back a second voltage to the first end of the right-channel headset through the right-channel circuit when the left-channel circuit outputs the left-channel audio signal;

the first current path is configured to shunt a current output by the left-channel circuit to adjust the second voltage, wherein when the left-channel circuit outputs the left-channel audio signal and the right-channel circuit does not output the right-channel audio signal, the second voltage is equal to a voltage at the second end of the right-channel headset; and the second current path is configured to shunt a current output by the right-channel circuit to adjust the first voltage, wherein when the right-channel circuit outputs the right-channel audio signal and the left-channel circuit does not output the left-channel audio signal, the first voltage is equal to a voltage at the second end of the left-channel headset.

2. The circuit according to claim 1, wherein:

the first current path comprises a first impedance, wherein a first end of the first impedance is coupled to the output end of the left-channel circuit and the first end of the left-channel headset, and a second end of the first impedance is coupled to the input end of the second feedback circuit and the second end of the left-channel headset; and the second current path comprises a second impedance, wherein a first end of the second impedance is coupled to the output end of the right-channel circuit and the first end of the right-channel headset, and a second end of the second impedance is coupled to the input end of the first feedback circuit and the second end of the right-channel headset.

3. The circuit according to claim 1, wherein:

the left-channel circuit, the right-channel circuit, the first feedback circuit, and the second feedback circuit are integrated in an audio chip;

the first current path is coupled to the output end of the left-channel circuit and the input end of the second feedback circuit through a chip interface of the audio chip, the output end of the left-channel circuit is coupled to the first end of the left-channel headset through the chip interface of the audio chip, and the input end of the first feedback circuit is coupled to the second end of the left-channel headset through the chip interface of the audio chip; and the second current path is coupled to the output end of the right-channel circuit and the input end of the first feedback circuit through the chip interface of the audio chip, the output end of the right-channel circuit is coupled to the first end of the right-channel headset through the chip interface of the audio chip, and the input end of the second feedback circuit is coupled to the second end of the right-channel headset through the chip interface of the audio chip.

4. The circuit according to claim 1, wherein:

the left-channel circuit, the right-channel circuit, the first feedback circuit, the second feedback circuit, the first current path, and the second current path are integrated in an audio chip;

the output end of the left-channel circuit is coupled to the first end of the left-channel headset through a chip interface of the audio chip, and the input end of the first feedback circuit is coupled to the second end of the left-channel headset through the chip interface of the audio chip; and the output end of the right-channel circuit is coupled to the first end of the right-channel headset through the chip interface of the audio chip, and the input end of the second feedback circuit is coupled to the second end of the right-channel headset through the chip interface of the audio chip.

5. The circuit according to claim 2, wherein:

the output end of the left-channel circuit is coupled to the first end of the left-channel headset through a headset interface, and the output end of the right-channel circuit is coupled to the first end of the right-channel headset through the headset interface, wherein an equivalent impedance generated between the headset interface and a stereo headset is a first equivalent impedance Rx, and the stereo headset comprises the left-channel headset and the right-channel headset;

the input end of the first feedback circuit is coupled to the second end of the left-channel headset through the headset interface, and the input end of the second feedback circuit is coupled to the second end of the right-channel headset through the headset interface, wherein an equivalent impedance generated between the headset interface and a feedback circuit is a second equivalent impedance Ry, and the feedback circuit comprises the first feedback circuit and the second feedback circuit; and a sound source ground is coupled to the second end of the left-channel headset and the second end of the right-channel headset through the headset interface, wherein an equivalent impedance generated by the headset interface coupled to the sound source ground is a third equivalent impedance Re, and a voltage of the sound source ground is a reference voltage when the left-channel circuit or the right-channel circuit does not output an audio signal.

6. The circuit according to claim 5, wherein:

a value of the first impedance is as follows:

$$Rrfb = \frac{(Rr + Rx) * (Ry - x1 * \mathrm{Re} + \mathrm{Re})}{(x1 - 1) * \mathrm{Re} + x1 * Rx} - Ry$$

wherein Rrfb is the value of the first impedance; Rr is an equivalent impedance of the right-channel headset; and 1/x1 is a product of an amplification factor of the left-channel circuit and an amplification factor of the first feedback circuit; and a value of the second impedance is as follows:

$$Rlfb = \frac{(Rl + Rx) * (Ry - x2 * \mathrm{Re} + \mathrm{Re})}{(x2 - 1) * Re + x2 * Rx} - Ry$$

wherein Rlfb is the value of the second impedance; Rl is an equivalent impedance of the left-channel headset; and 1/x2 is a product of an amplification factor of the right-channel circuit and an amplification factor of the second feedback circuit.

7. An audio playback circuit, comprising a left-channel circuit, a right-channel circuit, and a third current path, wherein:

an output end of the left-channel circuit is coupled to a first end of a left-channel headset, an output end of the right-channel circuit is coupled to a first end of a right-channel headset, and a second end of the left-channel headset is coupled to a second end of the right-channel headset;

the left-channel circuit is configured to output a left-channel audio signal to the first end of the left-channel headset;

the right-channel circuit is configured to output a right-channel audio signal to the first end of the right-channel headset;

a first end of the third current path is coupled to the output end of the left-channel circuit and the first end of the left-channel headset, and a second end of the third current path is coupled to the output end of the right-channel circuit and the first end of the right-channel headset;

the third current path is configured to shunt a current output by the left-channel circuit to adjust a third voltage input to the first end of the right-channel headset when the left-channel circuit outputs a left-channel audio signal, wherein when the left-channel circuit outputs the left-channel audio signal and the right-channel circuit does not output the right-channel audio signal, the third voltage is equal to a voltage at the second end of the right-channel headset; and the third current path is further configured to shunt a current output by the right-channel circuit to adjust a fourth voltage input to the first end of the left-channel headset when the right-channel circuit outputs the right-channel audio signal, wherein when the right-channel circuit outputs the right-channel audio signal and the left-channel circuit does not output the left-channel audio signal, the fourth voltage is equal to a voltage at the second end of the left-channel headset.

8. The circuit according to claim 7, wherein;

the third current path comprises a third impedance, wherein a first end of the third impedance is coupled to the output end of the left-channel circuit and the first end of the left-channel headset, and a second end of the third impedance is coupled to the output end of the right-channel circuit and the first end of the right-channel headset.

9. The circuit according to claim 8, wherein:

the output end of the left-channel circuit is coupled to the first end of the left-channel headset through a headset interface, and the output end of the right-channel circuit is coupled to the first end of the right-channel headset through the headset interface, wherein an equivalent impedance generated between the headset interface and a stereo headset is a first equivalent impedance Rx, and the stereo headset comprises the left-channel headset and the right-channel headset; and a sound source ground is coupled to the second end of the left-channel headset and the second end of the right-channel headset through the headset interface, wherein an equivalent impedance generated by the headset interface coupled to the sound source ground is a third equivalent impedance Re, and a voltage of the sound source ground is a voltage at the first end of the left-channel headset when the left-channel headset does not output the left-channel audio signal.

10. The circuit according to claim 9, wherein a value of the third impedance is as follows:

$$Rfb = \frac{Rb * Rr}{Rx + \mathrm{Re}} \text{ or } Rfb = \frac{Rb * Rl}{Rx + \mathrm{Re}}$$

wherein Rfb is the value of the third impedance: Rr is an equivalent impedance of the right-channel headset; Rl is an equivalent impedance of the left-channel headset; and Rb is an equivalent ground impedance, wherein the third current path is coupled to the sound source ground through the equivalent ground impedance.

11. A terminal, comprising:

a headset interface;

an audio playback circuit having an output end coupled to the headset interface; and a processor coupled to an input end of the audio playback circuit, wherein the processor is configured to input an audio signal to the audio playback circuit;

the headset interface is configured to connect to an external stereo headset having a left-channel headset and a right-channel headset; and wherein the audio playback circuit comprises a left-channel circuit, a right-channel circuit, a first feedback circuit, a second feedback circuit, a first current path, and a second current path, wherein:

an output end of the left-channel circuit is coupled to a first end of a left-channel headset, an input end of the first feedback circuit is coupled to a second end of the left-channel headset, and an output end of the first feedback circuit is coupled to an input end of the left-channel circuit;

an output end of the right-channel circuit is coupled to a first end of a right-channel headset, an input end of the second feedback circuit is coupled to a second end of the right-channel headset, and an output end of the second feedback circuit is coupled to an input end of the right-channel circuit, wherein the second end of the left-channel headset is coupled to the second end of the right-channel headset;

a first end of the first current path is coupled to the output end of the left-channel circuit and the first end of the left-channel headset, and a second end of the first current path is coupled to the input end of the second feedback circuit and the second end of the left-channel headset;

a first end of the second current path is coupled to the output end of the right-channel circuit and the first end of the right-channel headset, and a second end of the second current path is coupled to the input end of the first feedback circuit and the second end of the right-channel headset;

the left-channel circuit is configured to output a left-channel audio signal to the first end of the left-channel headset;

the right-channel circuit is configured to output a right-channel audio signal to the first end of the right-channel headset;

the first feedback circuit is configured to feed back a first voltage to the first end of the left-channel headset through the left-channel circuit when the right-channel circuit outputs the right-channel audio signal;

the second feedback circuit is configured to feed back a second voltage to the first end of the right-channel headset through the right-channel circuit when the left-channel circuit outputs the left-channel audio signal;

the first current path is configured to shunt a current output by the left-channel circuit to adjust the second voltage, wherein when the left-channel circuit outputs the left-channel audio signal and the right-channel circuit does not output the right-channel audio signal, the second voltage is equal to a voltage at the second end of the right-channel headset; and the second current path is configured to shunt a current output by the right-channel circuit to adjust the first voltage, wherein when the right-channel circuit outputs the right-channel audio signal and the left-channel circuit does not output the left-channel audio signal, the first voltage is equal to a voltage at the second end of the left-channel headset.

12. The terminal according to claim 11, wherein:

the first current path comprises a first impedance, wherein a first end of the first impedance is coupled to the output end of the left-channel circuit and the first end of the left-channel headset, and a second end of the first impedance is coupled to the input end of the second feedback circuit and the second end of the left-channel headset; and the second current path comprises a second impedance, wherein a first end of the second impedance is coupled to the output end of the right-channel circuit and the first end of the right-channel headset, and a second end of the second impedance is coupled to the input end of the first feedback circuit and the second end of the right-channel headset.

13. The terminal according to claim 11, wherein:

the left-channel circuit, the right-channel circuit, the first feedback circuit, and the second feedback circuit are integrated in an audio chip;

the first current path is coupled to the output end of the left-channel circuit and the input end of the second feedback circuit through a chip interface of the audio chip, the out put end of the left-channel circuit is coupled to the first end of the left-channel headset through the chip interface of the audio chip, and the input end of the first feedback circuit is coupled to the second end of the left-channel headset through the chip interface of the audio chip; and the second current path is coupled to the output end of the right-channel circuit and the input end of the first feedback circuit through the chip interface of the audio chip, the output end of the right-channel circuit is coupled to the first end of the right-channel headset through the chip interface of the audio chip, and the input end of the second feedback circuit is coupled to the second end of the right-channel headset through the chip interface of the audio chip.

14. The terminal according to claim 11, wherein:

the left-channel circuit, the right-channel circuit, the first feedback circuit, the second feedback circuit, the first current path, and the second current path are integrated in an audio chip;

the output end of the left-channel circuit is coupled to the first end of the left-channel headset through a chip interface of the audio chip, and the input end of the first feedback circuit is coupled to the second end of the left-channel headset through the chip interface of the audio chip; and the output end of the right-channel circuit is coupled to the first end of the right-channel headset through the chip interface of the audio chip, and the input end of the second feedback circuit is coupled to the second end of the right-channel headset through the chip interface of the audio chip.

15. The terminal according to claim 12, wherein:

the output end of the left-channel circuit is coupled to the first end of the left-channel headset through a headset interface, and the output end of the right-channel circuit is coupled to the first end of the right-channel headset through the headset interface, wherein an equivalent impedance generated bet ween the headset interface and a stereo headset is a first equivalent impedance Rx, and the stereo headset comprises the left-channel headset and the right-channel headset;

the input end of the first feedback circuit is coupled to the second end of the left-channel headset through the headset interface, and the input end of the second feedback circuit is coupled to the second end of the right-channel headset through the headset interface, wherein an equivalent impedance generated between the headset interface and a feedback circuit is a second equivalent impedance Ry, and the feedback circuit comprises the first feedback circuit and the second feedback circuit; and a sound source ground is coupled to the second end of the left-channel headset and the second end of the right-channel headset through the headset interface, wherein an equivalent impedance generated by the headset interface coupled to the sound source ground is a third equivalent impedance Re, and a voltage of the sound source ground is a reference voltage when the left-channel circuit or the right-channel circuit does not output an audio signal.

16. The terminal according to claim 15, wherein:

a value of the first impedance is as follows:

$$Rrfb = \frac{(Rr + Rx) * (Ry - x1 * \mathrm{Re} + \mathrm{Re})}{(x1 - 1) * \mathrm{Re} + x1 * Rx} - Ry$$

wherein Rrfb is the value of the first impedance; Rr is an equivalent impedance of the right-channel headset; and 1/x1 is a product of an amplification factor of the left-channel circuit and an amplification factor of the first feedback circuit; and a value of the second impedance is as follows:

$$Rlfb = \frac{(Rl + Rx) * (Ry - x2 * \mathrm{Re} + \mathrm{Re})}{(x2 - 1) * \mathrm{Re} + x2 * Rx} - Ry$$

wherein Rlfb is the value of the second impedance; Rl is an equivalent impedance of the left-channel headset; and 1/x2 is a product of an amplification factor of the right-channel circuit and an amplification factor of the second feedback circuit.

* * * * *